US007396099B2

(12) United States Patent
Teshigawara et al.

(10) Patent No.: US 7,396,099 B2
(45) Date of Patent: Jul. 8, 2008

(54) PRINTING APPARATUS, METHOD OF SETTING PRINT POSITION ADJUSTMENT VALUE, AND PRINTING METHOD

(75) Inventors: Minoru Teshigawara, Kanagawa (JP); Kiichiro Takahashi, Kanagawa (JP); Osamu Iwasaki, Tokyo (JP); Satoshi Seki, Kanagawa (JP); Naoji Otsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 10/929,685

(22) Filed: Aug. 31, 2004

(65) Prior Publication Data

US 2005/0057600 A1 Mar. 17, 2005

(30) Foreign Application Priority Data

Sep. 4, 2003 (JP) ..... 2003-313178

(51) Int. Cl.
*B41J 29/393* (2006.01)
*B41J 29/38* (2006.01)
*B41J 2/21* (2006.01)

(52) U.S. Cl. ..... 347/19; 347/12; 347/43

(58) Field of Classification Search ..... 347/19
See application file for complete search history.

(56) References Cited

U.S. PATENT DOCUMENTS 5,980,016 A * 11/1999 Nelson et al. ..... 347/19
6,036,298 A * 3/2000 Walker ..... 347/19
6,092,939 A 7/2000 Nishikori et al. ..... 400/61
6,196,736 B1 * 3/2001 Otsuki et al. ..... 400/124.01
6,257,143 B1 7/2001 Iwasaki et al. ..... 101/481
6,267,519 B1 * 7/2001 Otsuki et al. ..... 347/19
6,371,592 B1 4/2002 Otsuka et al. ..... 347/19
6,454,383 B2 * 9/2002 Lund et al. ..... 347/19
6,456,733 B1 * 9/2002 Miyauchi et al. ..... 382/112
6,464,321 B1 10/2002 Nunokawa ..... 347/19
6,485,124 B1 * 11/2002 King et al. ..... 347/19
6,572,213 B2 * 6/2003 Valero ..... 347/19
6,832,825 B1 * 12/2004 Nishikori et al. ..... 347/19
2002/0126172 A1 9/2002 Akiyama ..... 347/19

FOREIGN PATENT DOCUMENTS

JP 10-329381 12/1998
JP 2000-037936 2/2000
JP 2001-105635 4/2001
JP 2001-130112 5/2001

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

If print agents used are detected by an optical sensor at different sensitivities, the present invention enables the easy setting of adjustment values for print positions resulting from these print agents. To accomplish this object, for example, the present invention substitutes and sets adjustment values for print positions resulting from cyan, light cyan, or black ink, corresponding to a high detection sensitivity, for adjustment values for print positions resulting from a light magenta, yellow, or magenta ink, corresponding to a low detection sensitivity.

18 Claims, 32 Drawing Sheets

BIDIRECTIONAL ADJUSTMENT

| ITEM NUMBER | CHIP NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|---|
| G | 1 | CYAN | C1 | 5.7 | 13.0 | ○ |
| H | | LIGHT MAGENTA | LM1 | | | × |
| I | 2 | BLACK | K1 | | | ○ |
| J | | YELLOW | Y1 | | | × |
| K | 3 | LIGHT CYAN | LC1 | | | ○ |
| L | | MAGENTA | M1 | | | × |

BIDIRECTIONAL ADJUSTMENT

| ITEM NUMBER | CHIP NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|---|
| H | 1 | LIGHT MAGENTA | LM1 | 5.7 | 13.0 | G |
| J | 2 | YELLOW | Y1 | | | I |
| L | 3 | MAGENTA | M1 | | | K |

DOT NON-FORMED PART

DOT NON-FORMED PART

DOT NON-FORMED PART

DOT NON-FORMED PART

DOT FORMED
PART OF BLACK INK

DOT FORMED
PART OF BLACK INK

DOT FORMED
PART OF BLACK INK

DOT FORMED
PART OF BLACK INK

DOT FORMED
PART OF CYAN INK

DOT FORMED
PART OF CYAN INK

DOT FORMED
PART OF CYAN INK

DOT FORMED
PART OF CYAN INK

DOT FORMED
PART OF MAGENTA INK

DOT FORMED
PART OF MAGENTA INK

DOT FORMED
PART OF MAGENTA INK

DOT FORMED
PART OF MAGENTA INK

DOT FORMED
PART OF YELLOW INK

DOT FORMED
PART OF YELLOW INK

DOT FORMED
PART OF YELLOW INK

DOT FORMED
PART OF YELLOW INK

ODD-EVEN ROW ADJUSTMENT

| ITEM NUMBER | CHIP NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|---|
| A | 1 | CYAN | C1 | 5.7 | 13.0 | ○ |
| | | | C2 | | | |
| B | | LIGHT MAGENTA | LM1 | | | × |
| | | | LM2 | | | |
| C | 2 | BLACK | K1 | | | ○ |
| | | | K2 | | | |
| D | | YELLOW | Y1 | | | × |
| | | | Y2 | | | |
| E | 3 | LIGHT CYAN | LC1 | | | ○ |
| | | | LC2 | | | |
| F | | MAGENTA | M1 | | | × |
| | | | M2 | | | |

FIG.21A

BIDIRECTIONAL ADJUSTMENT

| ITEM NUMBER | CHIP NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|---|
| G | 1 | CYAN | C1 | 5.7 | 13.0 | ○ |
| H | | LIGHT MAGENTA | LM1 | | | × |
| I | 2 | BLACK | K1 | | | ○ |
| J | | YELLOW | Y1 | | | × |
| K | 3 | LIGHT CYAN | LC1 | | | ○ |
| L | | MAGENTA | M1 | | | × |

FIG.21B

CHIP ADJUSTMENT

| ITEM NUMBER | CHIP NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|---|
| G | 1 - 2 | CYAN-BLACK | C1 | 5.7 | 13.0 | ○ |
| | | | K1 | | | |
| H | 2 - 3 | BLACK-LIGHT CYAN | K1 | | | ○ |
| | | | LC1 | | | |

FIG.21C

ODD-EVEN ROW ADJUSTMENT

| ITEM NUMBER | CHIP NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|---|
| B | 1 | LIGHT MAGENTA | LM1 | 5.7 | 13.0 | A |
| | | | LM2 | | | |
| D | 2 | YELLOW | Y1 | | | C |
| | | | Y2 | | | |
| F | 3 | MAGENTA | M1 | | | E |
| | | | M2 | | | |

FIG.22A

BIDIRECTIONAL ADJUSTMENT

| ITEM NUMBER | CHIP NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|---|
| H | 1 | LIGHT MAGENTA | LM1 | 5.7 | 13.0 | G |
| J | 2 | YELLOW | Y1 | | | I |
| L | 3 | MAGENTA | M1 | | | K |

FIG.22B

ODD-EVEN ROW ADJUSTMENT

| ITEM NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|
| A | CYAN (LARGE) | C1 | 5.7 | 13.0 | ○ |
| | | C2 | | | |
| B | CYAN (SMALL) | C3 | 2.3 | 15.0 | ○ |
| | | C4 | | | |
| C | MAGENTA (LARGE) | M1 | 5.7 | 13.0 | × |
| | | M2 | | | |
| D | MAGENTA (SMALL) | M3 | 2.3 | 15.0 | × |
| | | M4 | | | |
| E | YELLOW | Y1 | 5.7 | 13.0 | × |
| | | Y2 | | | |
| F | BLACK | K1 | 5.7 | 13.0 | ○ |
| | | K2 | | | |

FIG.24A

BIDIRECTIONAL ADJUSTMENT

| ITEM NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|
| G | CYAN (LARGE) | C1 | 5.7 | 13.0 | ○ |
| H | CYAN (SMALL) | C3 | 2.3 | 15.0 | ○ |
| I | MAGENTA (LARGE) | M1 | 5.7 | 13.0 | × |
| J | MAGENTA (SMALL) | M3 | 2.3 | 15.0 | × |
| K | YELLOW | Y1 | 5.7 | 13.0 | × |
| L | BLACK | K1 | | | ○ |

FIG.24B

LARGE/SMALL DOT ROW ADJUSTMENT

| ITEM NUMBER | COLOR AGENT | NOZZLE ROW NAME | EJECTION AMOUNT [ng] | EJECTION SPEED [m/sec] | POSSIBILITY OF PRINT REGISTRATION |
|---|---|---|---|---|---|
| M | CYAN (LARGE) - CYAN (SMALL) | C1 | 5.7 | 13.0 | ○ |
| | | C3 | 2.3 | 15.0 | |
| N | MAGENTA (LARGE) - MAGENTA (SMALL) | M1 | 5.7 | 13.0 | × |
| | | M3 | 2.3 | 15.0 | |

FIG.24C

ODD-EVEN ROW ADJUSTMENT

| ITEM NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|
| B | MAGENTA (LARGE) | M1 | 5.7 | 13.0 | A |
| | | M2 | | | |
| D | MAGENTA (SMALL) | M3 | 2.3 | 15.0 | B |
| | | M4 | | | |
| F | YELLOW | Y1 | 5.7 | 13.0 | F |
| | | Y2 | | | |

FIG.25A

BIDIRECTIONAL ADJUSTMENT

| ITEM NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|
| I | MAGENTA (LARGE) | M1 | 5.7 | 13.0 | G |
| J | MAGENTA (SMALL) | M3 | 2.3 | 15.0 | H |
| K | YELLOW | Y1 | 5.7 | 13.0 | L |

FIG.25B

LARGE/SMALL DOT ROW ADJUSTMENT

| ITEM NUMBER | COLOR AGENT | NOZZLE ROW NAME | EJECTION AMOUNT [ng] | EJECTION SPEED [m/sec] | ITEM NUMBER FOR SUBSTITUTIVE ADJUSTMENT VALUES |
|---|---|---|---|---|---|
| N | MAGENTA (LARGE) - MAGENTA (SMALL) | M1 | 5.7 | 13.0 | M |
| | | M3 | 2.3 | 15.0 | |

FIG.25C

PRINTING APPARATUS, METHOD OF SETTING PRINT POSITION ADJUSTMENT VALUE, AND PRINTING METHOD

BACKGROUND OF THE INVENTION

1. Field of the Invention

The present invention relates to a printing apparatus that uses an optical sensor to detect a print position adjusting pattern printed on a printing medium and which acquires adjustment values used to adjust print positions on the basis of the results of the detection, as well as a method of setting print position adjustment values, and a printing method.

2. Description of the Related Art

In the prior art, print registration (print position adjustment) in a printing apparatus of this kind is ordinarily carried out as described below. For example, in reciprocative printing, when print registration is executed between a forward scan (forward printing) and a backward scan (backward printing), the forward and backward scans are used to print ruled lines on a printing medium as a print position adjusting pattern. When the ruled lines are printed, print timings between the forward scan and the backward scan are adjusted to vary relative print conditions. Further, if a plurality of heads are used, the print registration between the print heads is carried out by using the plurality of print heads to print ruled lines on a printing medium as print position adjusting pattern. When the ruled lines are printed, print timings between the print heads scan are adjusted to vary relative print conditions.

A user or the like observes the results of such printing to select the ruled line printed under print conditions resulting in the most appropriate print position. Then, on the basis of the print conditions under which the ruled line was printed, the print conditions for print registration are set for a printing apparatus or host computer as print position adjustment values. However, such a conventional method of print registration requires the user or the like to check the results of printing to select and set registration conditions. This is cumbersome.

Thus, Japanese Patent Laid-open No. 10-329381 describes a technique to use an optical sensor to read a print position adjusting pattern. Specifically, in connection with a first and second prints (prints resulting from a forward and backward scans, respectively, or prints obtained using a plurality of heads) as print registration targets, print position adjusting patterns having different amounts of deviation in relative print position are printed on a printing medium. Then, an optical sensor composed of a light emitting section (commonly LEDs) and a light receiving section (commonly phototransistors) is used to measure optical characteristics of the printed adjusting patterns such as a reflection density. Then, on the basis of the measurements, conditions for the print registration between the first and second prints are determined.

Further, in printing apparatuses capable of printing colored images in multiple colors, print agents for tones such as cyan, magenta, and yellow are commonly used in addition to black. Moreover, in recent years, there have been printing apparatuses using a light cyan or light magenta ink in order to reduce the granular impression of dots formed when the ink impacts a printing medium. A technique has also been proposed which favorably measures the optical characteristics of print registration patterns (print position adjusting patterns) formed using the plurality of print agents having the different tones (Japanese Patent Laid-open No. 2001-105635). Specifically, a color filter is provided in a light emitting section of an optical sensor to increase an S/N ratio for parts in which dots are formed and parts in which no dots are formed, when the optical characteristics are measured.

These techniques enable the print registration to be easily carried out without troubling the user. However, the printing apparatus using print agents having different tones require a light source with a large wavelength region which operates as the light emitting section of the optical sensor, a color filter that restricts the wavelength region, and a mechanism that correspondingly controls the switching of the color filter. This disadvantageously increases costs and the size of the apparatuses.

SUMMARY OF THE INVENTION

It is an object of the present invention to provide a printing apparatus, a method of setting print position adjustment values, and a printing method wherein if print agents are used which are detected by an optical sensor at different detection sensitivities, it is possible to easily set adjustment values for print positions resulting from these print agents.

In the first aspect of the present invention, there is provided a printing apparatus for printing on a printing medium by using a print head capable of applying different print agents to the printing medium, the apparatus comprising:

pattern print control means for printing a predetermined print position adjusting pattern on the printing medium by using the print head and at least one of the different print agents;

an optical sensor for detecting optical characteristics of a part of the printing medium in which the print position adjusting pattern is printed; and adjustment value setting means for setting adjustment values for print positions resulting from the at least one print agent, on the basis of results of detection by the optical sensor, and wherein the adjustment value setting means substitutes and sets adjustment values for print positions resulting from a print agent that can be relatively accurately detected by the optical sensor for adjustment values for print positions resulting from a print agent that can be relatively inaccurately detected by the optical sensor.

In the second aspect of the present invention, there is provided a method of setting print position adjustment values used to set adjustment values for print positions resulting from different print agents in a printing apparatus that uses a print head capable of applying the different print agents to a printing medium, to execute printing on the printing medium, the method comprising:

a step of printing a predetermined print position adjusting pattern on the printing medium by using the print head and at least one of the different print agents;

a step of detecting optical characteristics of a part of the printing medium, by using an optical sensor, in which the print position adjusting pattern is printed; and a step of setting adjustment values for print positions resulting from the at least one print agent, on the basis of results of detection by the optical sensor, and wherein adjustment values for print positions resulting from a print agent that can be relatively accurately detected by the optical sensor are substituted and set for adjustment values for print positions resulting from a print agent that can be relatively inaccurately detected by the optical sensor.

In the third aspect of the present invention, there is provided a printing method for printing on a printing medium by using a print head capable of applying different print agents to the printing medium, the method comprising:

a step of printing a predetermined print position adjusting pattern on the printing medium by sing the print head and at least one of the different print agents;

a step of detecting optical characteristics of a part of the printing medium, by using an optical sensor, in which the print position adjusting pattern is printed; and a step of setting adjustment values for print positions resulting from the at least one print agent, on the basis of results of detection by the optical sensor, and wherein adjustment values for print positions resulting from a print agent that can be relatively accurately detected by the optical sensor are substituted and set for adjustment values for print positions resulting from a print agent that can be relatively inaccurately detected by the optical sensor.

In the fourth aspect of the present invention, there is provided a printing apparatus for printing on the printing medium by using a print head capable of ejecting different print agents to the printing medium, the apparatus comprising:

printing means for printing a predetermined print position adjusting pattern on the printing medium by using the print head and at least one of the different print agents;

detecting means for detecting the predetermined pattern printed on the printing medium; and setting means for setting adjustment values for print positions of ink ejected from the print head, on the basis of results of detection by the detecting means; and determining means for determining whether or not the setting means is used to set, for the predetermined print agent, adjustment values for the print positions on the basis of a difference between results of detection, by the detecting means, of an area on the printing medium in which the predetermined pattern is not printed and results of detection, by the detecting means, of the predetermined pattern printed by using the predetermined print agent.

In the present specification, the term "print" does not refer only to the formation of significant information such as letters or graphics. That is, the term broadly refers to the formation of images, patterns, or the like on a printing medium or the processing of a medium regardless of whether or not the information is significant or whether or not the information is manifested so as to be visually perceived by human beings.

The term "printing medium" broadly refers not only to paper used in common printing apparatuses but also to cloths, plastic films, metal plates, or other materials that can receive inks.

The term "ink" should be broadly interpreted as in the case of the definition of the term "prints". Specifically, the "ink" refers to a liquid also called a print agent and applied to a printing medium to form images, patterns, or the line on the printing medium or to process the printing medium.

Further, the optical characteristics used in the present specification are optical densities, that is, reflection optical density using reflectance and transmission optical density using transmittance. However, optical reflectivity or reflection optical intensity can also be used. In the present specification, the reflection optical density is used as an optical density or simply a density, unless this results in confusion.

According to the present invention, if print agents are used which are detected by an optical sensor at different detection sensitivities, an adjustment value for print positions resulting from a print agent with a high detection sensitivity is set for print positions resulting from a print agent with a low detection sensitivity. This makes it possible to easily set adjustment values for print positions resulting from the different print agents.

The above and other objects, effects, features and advantages of the present invention will become more apparent from the following description of embodiments thereof taken in conjunction with the accompanying drawings.

BRIEF DESCRIPTION OF THE DRAWINGS

FIGS. 21A, 21B, and 21C are tables illustrating a specific method of adjusting print positions according to the embodiment of the present invention;

FIGS. 22A and 22B are tables illustrating the substitution of adjustment values in the method of adjusting print positions, shown in FIGS. 21A and 21B;

FIGS. 24A, 24B, and 24C are tables illustrating a specific method of adjusting print positions according to the another embodiment of the present invention shown in FIG. 23; and FIGS. 25A, 25B, and 25C are tables illustrating the substitution of adjustment values in the method of adjusting print positions, shown in FIGS. 24A, 24B, and 24C.

DETAILED DESCRIPTION OF THE PREFERRED EMBODIMENTS

Embodiments of the present invention will be described below with reference to the drawings. Description will focus on the case in which the present invention is applied to an ink jet printing apparatus and a print system using the ink jet printing apparatus.

(1) Basic Configuration

First, description will be given of the basic configuration of an ink jet printing apparatus according to the present invention. Here, a printer based on an ink jet print system (an ink jet printer) will be described by way of example.

(1-1) First Example of Configuration of Main Part

Figure 1:
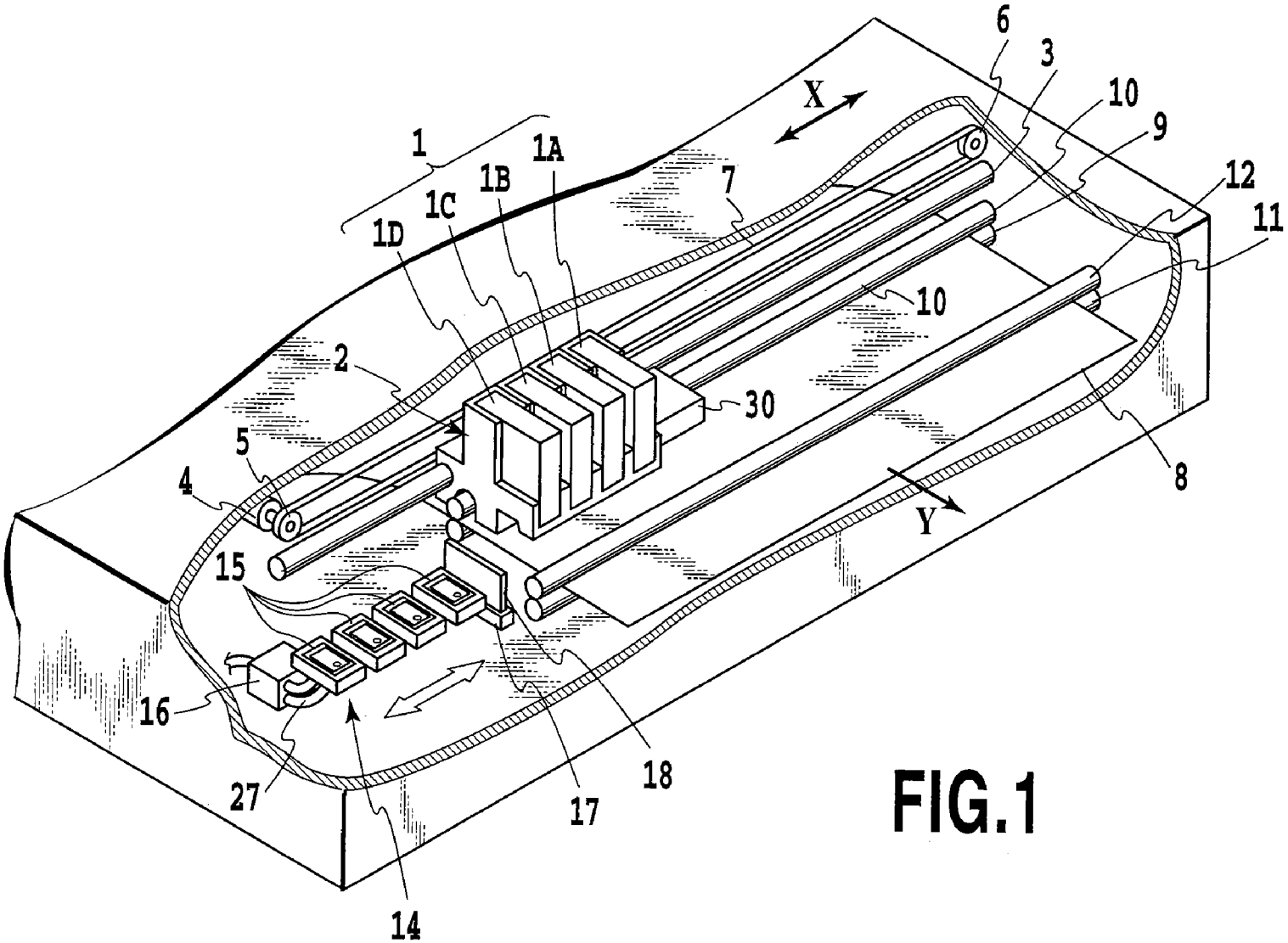
FIG. 1 is a perspective view illustrating a first example of the configuration of a main part of an ink jet printing apparatus to which the present invention is applicable.

FIG. 1 is a schematic perspective view illustrating a first example of the configuration of a main part of an ink jet printing apparatus to which the present invention is applicable.

In FIG. 1, a plurality of (four) head cartridges 1A, 1B, 1C, and 1D are exchangeably mounted on a carriage 2. Each of the head cartridges 1A to 1D has a print head section and an ink tank section, as well as a connector that transmits and receives signals used to drive the head section. In the description below, the whole or an arbitrary one of the head cartridges 1A to 1D is simply referred to as a print head 1 or a head cartridge 1.

The plurality of head cartridges 1 carry out printing using inks of different colors. For example, inks of different colors such as black, cyan, magenta, and yellow are housed in an ink tank section. The head cartridges 1 are positioned and exchangeably mounted on the carriage 2. The carriage 2 is provided with a connector holder (an electric connection section) to transmit a drive signal and the like to each head cartridge 1 via a connector of the head cartridge 1.

The carriage 2 is guided so as to reciprocate in a main scanning direction shown by an arrow X, along a guide shaft 3 installed in the apparatus main body so as to extend in the main scanning direction. The carriage 2 is a driven and has its position and movement controlled, by a main scanning motor 4 via drive mechanisms such as a motor pulley 5, a driven pulley 6, and timing belt 7. Two sets of rollers 9, 10 and 11, 12 rotate, to convey (feed) a printing medium 8 such as print sheets or thin plastic plates in a sub-scanning direction shown by an arrow Y, through a position (a print section) lying opposite an ejection opening surface (a surface in which ink ejection openings are formed) The printing medium 8 has its back surface supported by a platen (not shown) so as to form a flat print surface in the print section. The ejection opening surfaces of the head cartridges 1, mounted on the carriage 2, project downward from the carriage 2 and are held between the two sets of rollers 9, 10 and 11, 12 parallel to a front surface of the printing medium 8. Further, a reflection type optical sensor 30 is mounted to the carriage 2.

The head cartridge 1 is an ink jet head cartridge that ejects ink utilizing thermal energy. The head cartridge 1 comprises electrothermal converters (heaters) to generate thermal energy. Specifically, a print head section of the head cartridge 1 uses thermal energy generated by the electrothermal converters to boll the ink. Then, the bubbling energy of the ink is utilized to eject the ink from ejection openings toward the printing medium 8.

Reference numeral 14 denotes a recovery processing section that executes a recovery process to allow the print head section of the head cartridge 1 to constantly eject the ink appropriately. The recovery processing section 14 comprises a cap 15 that caps the ejection opening part of the print head section, a suction pump 16 connected by a pipe 27 to the interior of the cap 15, and a wiper blade 18 held by a holder.

(1-2) Second Example of Configuration of Main Part

Figure 2:
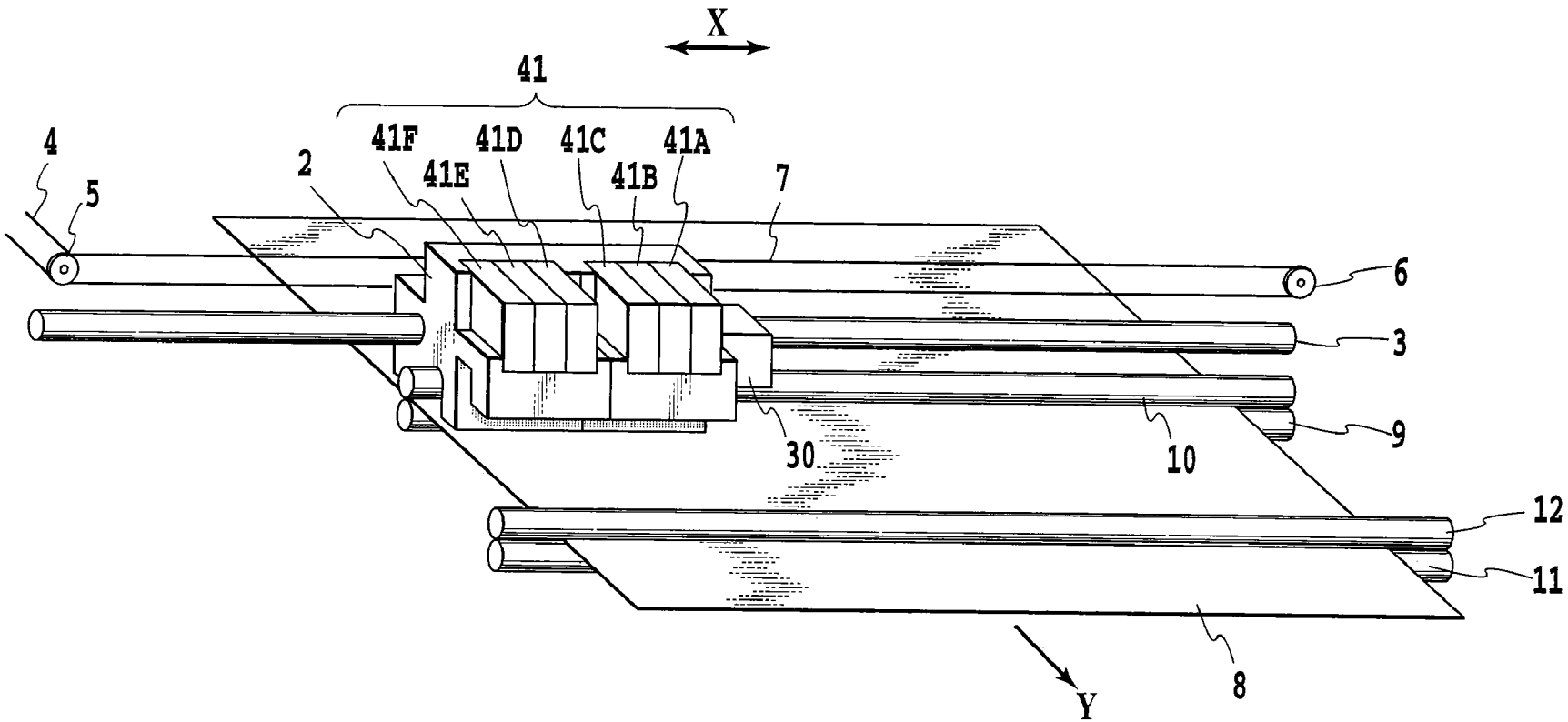
FIG. 2 is a perspective view illustrating a second example of the configuration of a main part of an ink jet printing apparatus to which the present invention is applicable.

FIG. 2 is a schematic perspective view illustrating a second example of the configuration of a main part of an ink jet printing apparatus to which the present invention is applicable. In FIG. 2, parts denoted by the same reference numerals as those in FIG. 1 provide the same functions as those in FIG. 1. Accordingly, their description is omitted.

In FIG. 2, a plurality of (six) head cartridges 41A, 41B, 41C, 41D, 41E, and 41F are exchangeably mounted on the carriage 2. Each of the head cartridges 41A to 41F is provided with a connector to receive signals that drive a print head section. In the description below, the whole or an arbitrary one of the head cartridges 41A to 41F is simply referred to as a print head 41 or a head cartridge 41 The plurality of head cartridges 41 carry out printing using inks of different colors. For example, inks of different colors such as black, cyan, magenta, yellow, light cyan, and light magenta are housed in an ink tank section. The head cartridges 41 are positioned and exchangeably mounted on the carriage 2. The carriage 2 is provided with a connector holder (an electric connection section) to transmit a drive signal and the like to each head cartridge 41 via a connector of the head cartridge 41.

(1-3) Print Section

A print section includes the carriage 2 movably supported by the guide shaft 3 and the head cartridges 1 (41) releasably mounted on the carriage 2.

Figure 3:
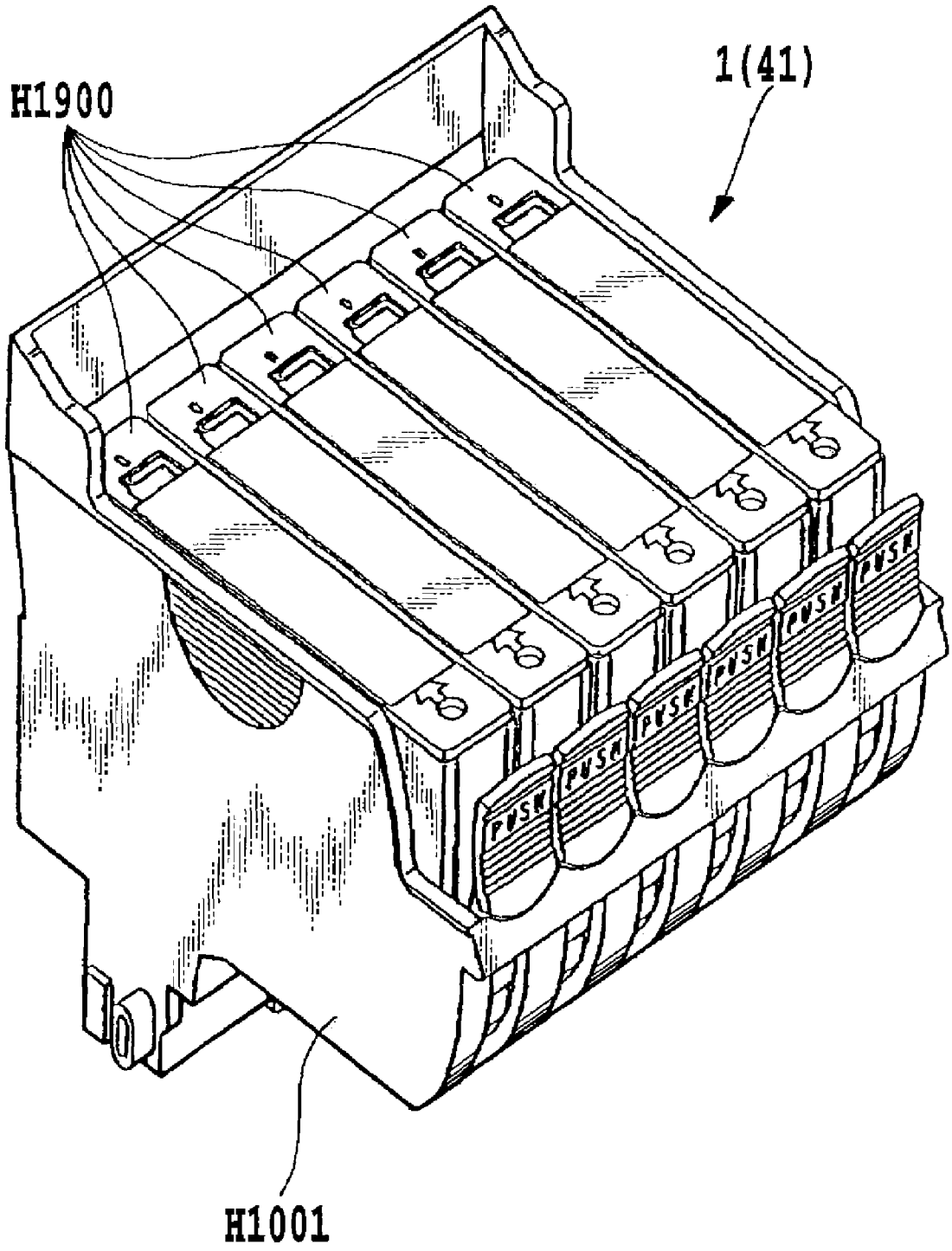
FIG. 3 is a perspective view of the head cartridge shown in FIGS. 1 and 2.
Figure 4:
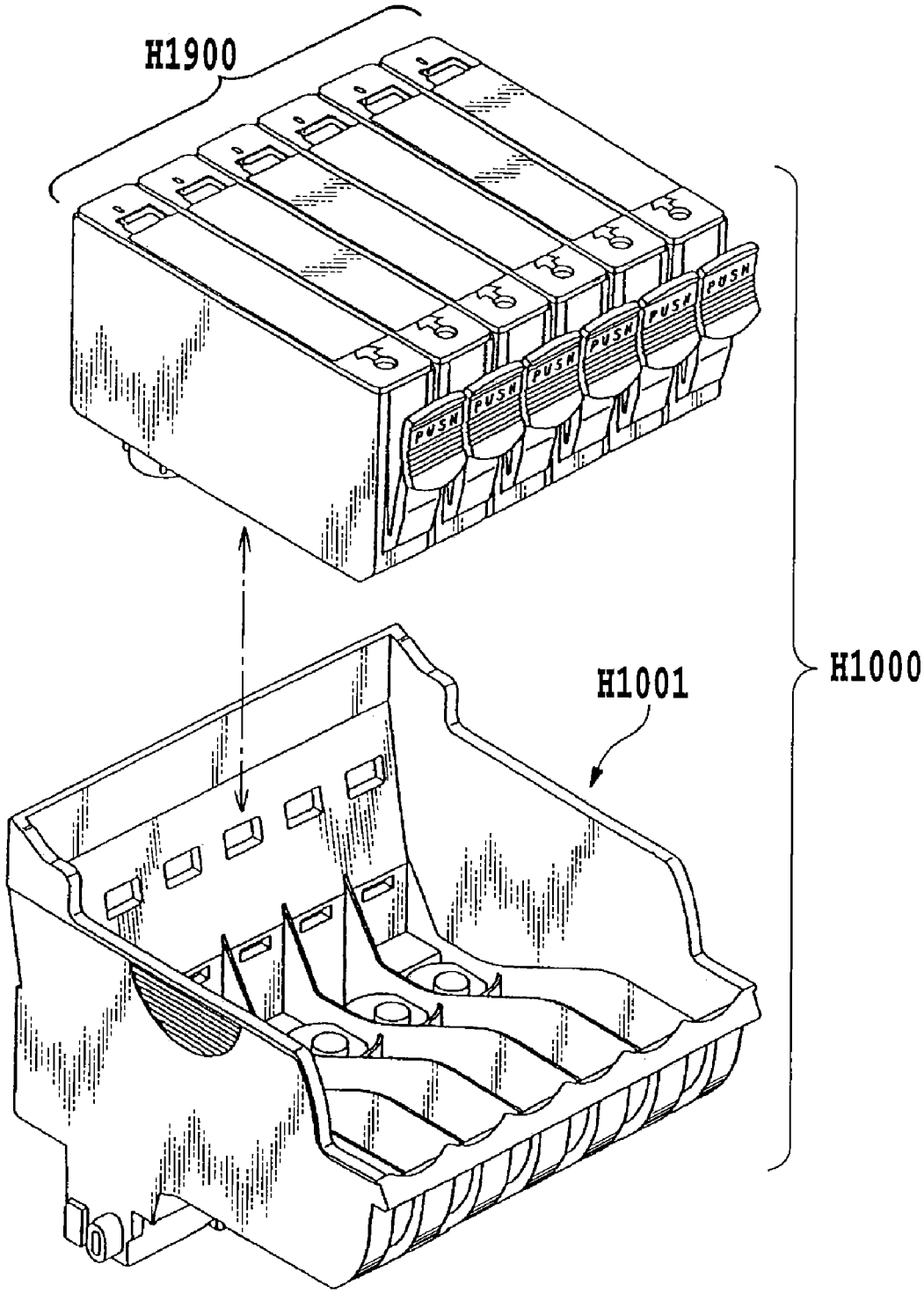
FIG. 4 is an exploded perspective view of the head cartridge shown in FIG. 3.
Figure 5:
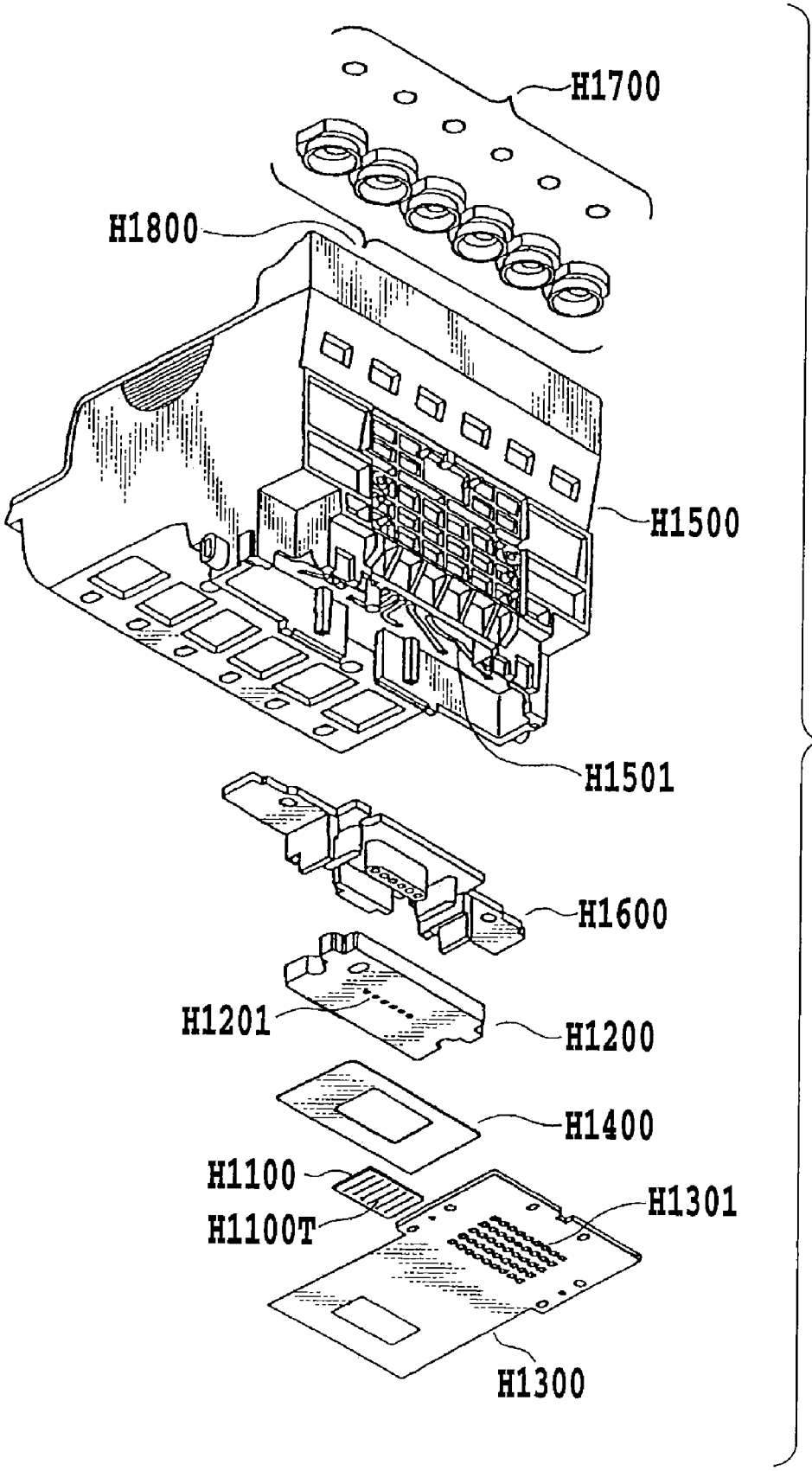
FIG. 5 is an exploded perspective view of the print head in FIG. 4 as viewed from below.

FIGS. 3 to 5 illustrate a specific example of the configuration of the head cartridges 1 (41). The head cartridge 1 (41) according to the present example has an ink tank H1900 in which an ink is stored and a print head H1001 that ejects an ink supplied by the ink tank H1900, from ejection openings in accordance with print information as shown in FIG. 3. The print head H1001 is of what it called a cartridge system in which the print head H1001 is releasably mounted on the carriage 2. The head cartridges 1 (41) according to the present example enable print photograph-like high-quality color images to be printed. Thus, ink tanks H1900 are provided which independently accommodate inks of, for example, black, light cyan, light magenta, cyan, magenta, and yellow. Each of the ink tanks H1900 can be released from the print head H1001.

As shown in the exploded perspective view in FIG. 5, the print head H1001 is composed of a plurality of print element circuit boards H1100, a first plate H1200, an electric wired circuit board H1300, a second plate H1400, a tank holder H1500, a channel forming member H1600, a filter H1700, and seal rubber H1800.

The print element circuit boards H1100 has a plurality of print elements and an electric wire such as Al formed on one surface of an Si substrate using a film forming technique; the print elements allow the ink to be ejected and the electric wire supplies power to each of the print elements. Further, a plurality of ink channels and a plurality of ejection openings H1100T corresponding to the print elements are formed on the print element circuit board H1100 by a photolithography technique. Moreover, ink supply ports are formed to open in the back surface of the Si substrate to supply the ink to the plurality of ink channels Furthermore, the print element circuit board H1100 is fixedly glued to the first plate H1200. Ink supply ports H1201 are formed in the plate H1200 to supply the ink to the print element circuit board H1100. Moreover, the second plate H1400, having openings, is fixedly glued to the first plate H1200. The electric wired circuit board H1300 is electrically connected to the print element circuit board H1100 via the second plate H1400. The electric wired circuit board H1300 applies electric signals to the print element circuit board H1100 to eject the ink. The electric wired circuit board H1300 has an electric wire corresponding to the print element circuit board H1100 and an external signal input terminal H1301 located at an end of the electric wire to receive electric signals from the printing apparatus main body. The external signal input terminal H1301 is fixedly positioned on a rear surface of the tank holder H1500.

On the other hand, the channel forming member H1600 is fixed by, for example, ultrasonic welding, to the tank holder H1500, which releasably holds the ink tanks H1900. This forms an ink channel 1501 extending from the ink tank H1900 to the first plate H1200. Further, the filter H1700 is provided at an ink tank side end of the ink channel H1501 which engages with the ink tank H1900, to prevent the entry of external dust. Furthermore, the seal rubber H1800 is installed on an engagement portion of the tank holder H1500 which engages with the ink tank H1900, to prevent the evaporation of the ink from the engagement portion.

A tank holder section is composed of the tank holder H1500, the channel forming member H1600, the filter H1700, and the seal rubber 1800. A print element section is composed of the print element circuit board H1100, the first plate H1200, the electric wired circuit board H1300, and the second plate H1400. The tank holder section and the print element section are coupled together by gluing or the like to constitute the print head H1001.

(1-4) Specific Configuration of Nozzles in Print Head

Figure 6:
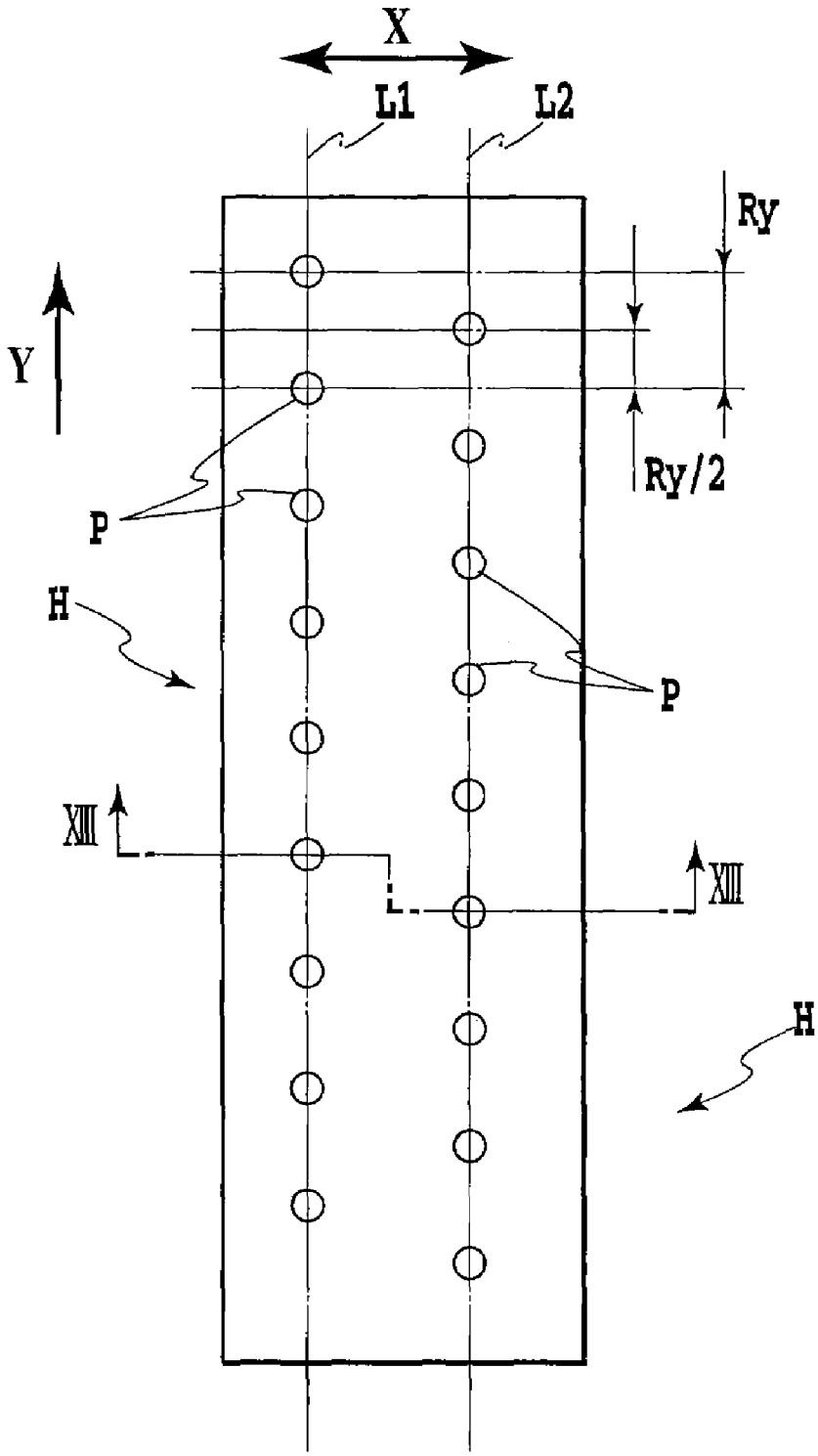
FIG. 6 is a bottom view of a basic nozzle arrangement portion of the print head.
Figure 7:
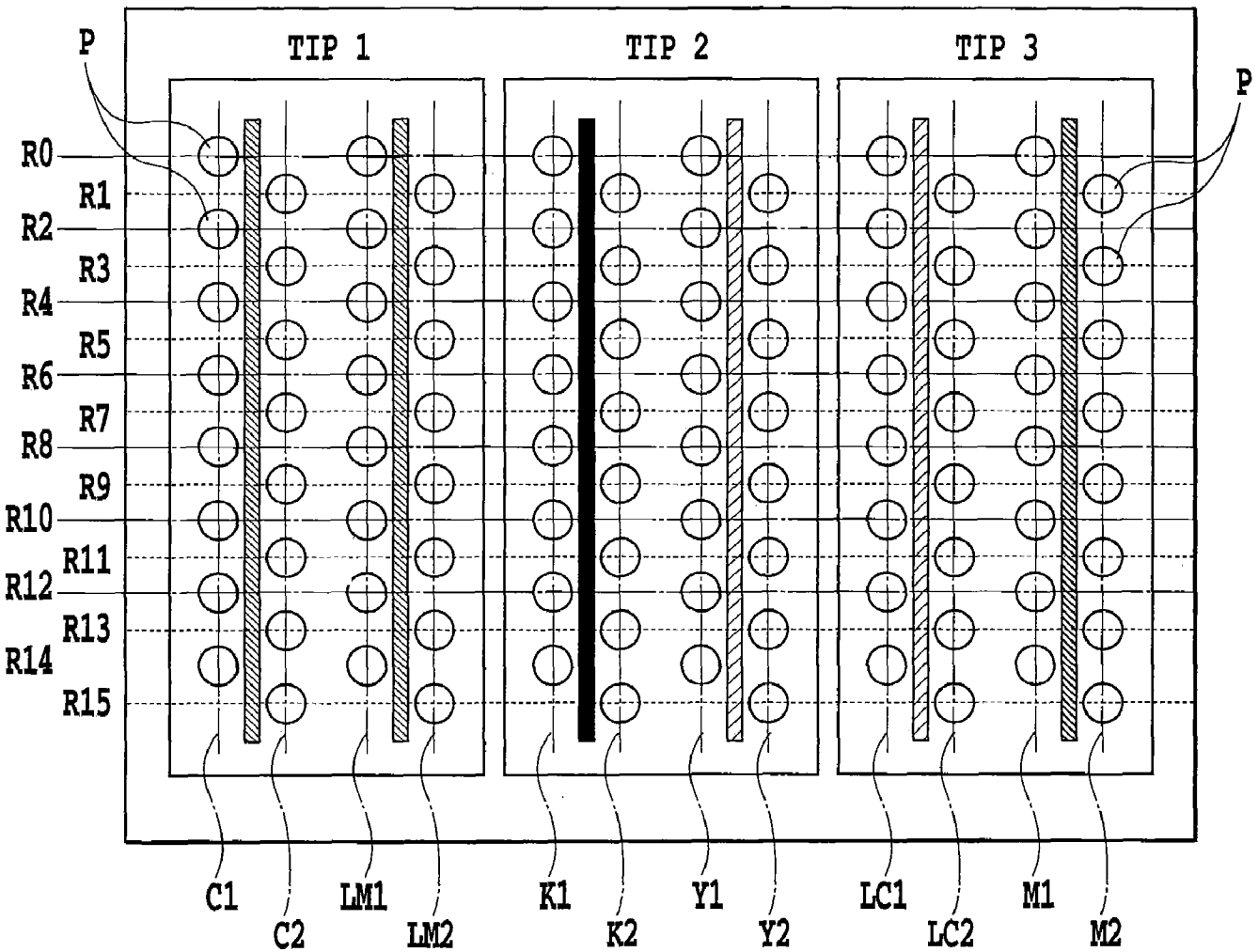
FIG. 7 is a bottom view of a main part of a print head comprising the basic nozzle arrangement shown in FIG. 6.
Figure 8:
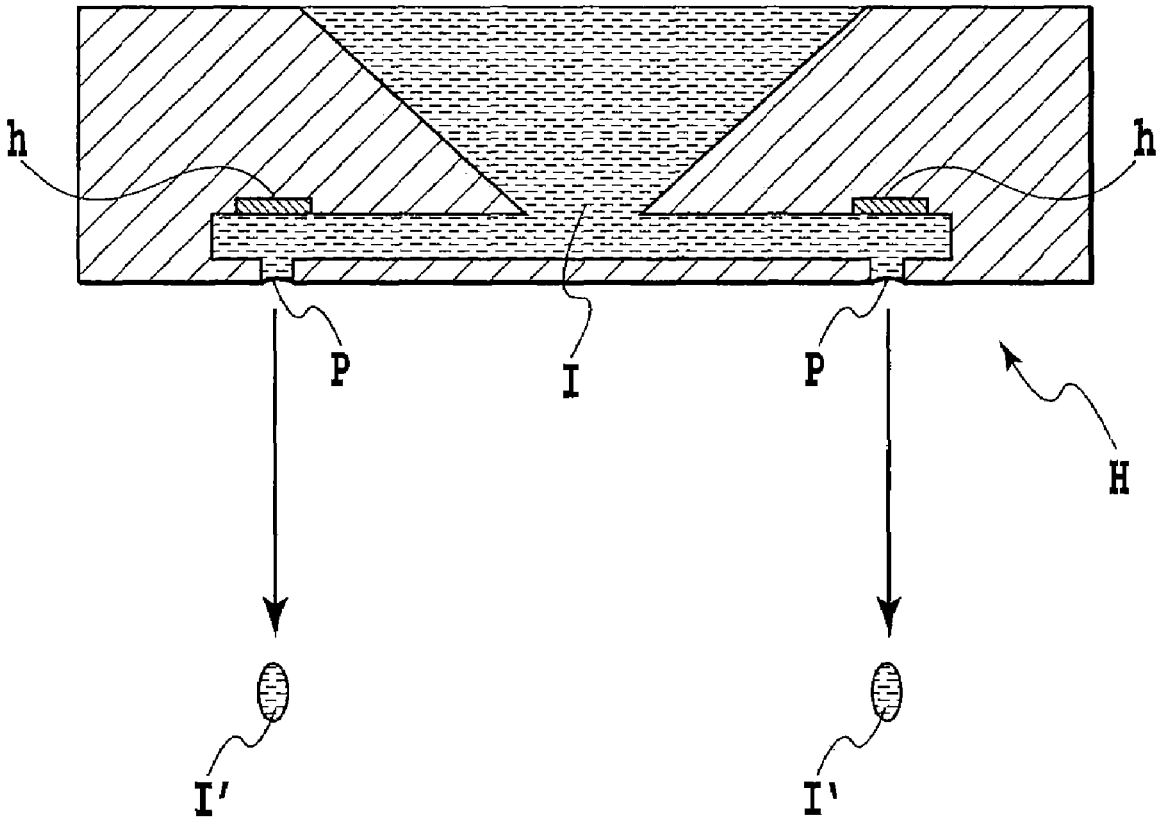
FIG. 8 is an enlarged sectional view taken along a line XIII-XIII in FIG. 6.

FIGS. 6 to 8 are diagrams illustrating a specific example of the configuration of nozzles formed by ejection openings H1100T in the print head H1001.

The print head H (H1001) according to the present example is formed with two lines (hereinafter also referred to as "nozzle lines") L1 and L2 each including a plurality of ejection openings P (H1100T) from which the ink can be ejected. The nozzle lines L1 and L2 extend in the sub-scanning direction, shown by an arrow Y and in which the printing medium is conveyed Each of the nozzle lines L1 and L2 is formed with 128 ejection openings P, constituting nozzles and arranged at a pitch Ry corresponding to 600 dpi. Further, each ejection opening P in the nozzle line L1 is misaligned with respect to the corresponding ejection opening P in the nozzle line L2 in the sub-scanning direction, shown by the arrow Y, by half a pitch (Ry/2) corresponding to 1,200 dpi. An arrow X denotes the main scanning direction, in which the print head H reciprocates. Then, an image can be printed at a dot density of 1,200 dpi in the sub-scanning direction by ejecting ink of the same color from a total of 256 ejection openings in the two rows. Consequently, the print resolution in the sub-scanning direction is twice that achieved with only one of the nozzle lines L1 and L2.

In the present example, six of the print head H configured as described above are combined together in association with six types of inks ejected, that is, a cyan (C) magenta (M), yellow (Y), and black (K) inks and a light cyan (LC) and a light magenta (LM) inks. The six combined print heads H are constructed so that every two print heads are provided on the same chip. Reference numerals C1 and C2 denote nozzle lines from which the cyan (C) ink is ejected. Reference numerals LM1 and LM2 denote nozzle lines from which the light magenta (LM) ink is ejected. Reference numerals K1 and K2 denote nozzle lines from which the black (K) in is ejected. Reference numerals Y1 and Y2 denote nozzle lines from which the yellow (Y) ink is ejected. Reference numerals LC1 and LC2 denote nozzle lines from which the light cyan (LC) ink is ejected. Reference numerals M1 and M2 denote nozzle lines from which the magenta (M) ink is ejected. In FIG. 7, the ink of each color is ejected from 16 ejection opening P having nozzle numbers R0 to R15. The cyan (C), magenta (M), yellow (Y) b black (K) inks are dark inks having a relatively high dye concentration. On the other hand, the Light cyan (LC) and light magenta (LM) inks are light inks having a relatively low dye concentration that is one-sixth of that of the dark inks. A color image can be printed by thus allowing the different inks to be ejected from the respective print heads H, in which the two nozzle lines L1 and L2 are formed.

In FIG. 8, h denotes a heater (electrothermal converter) that generates thermal energy in response to a drive signal, the thermal energy being utilized as ejection energy for ink droplets I'. The thermal energy of the heater h causes film boiling in the ink I in the nozzle, so that the resulting bubbling energy causes the ink droplets I' to be ejected from the ejection opening P.

(1-5) Optical Sensor

Figure 9:
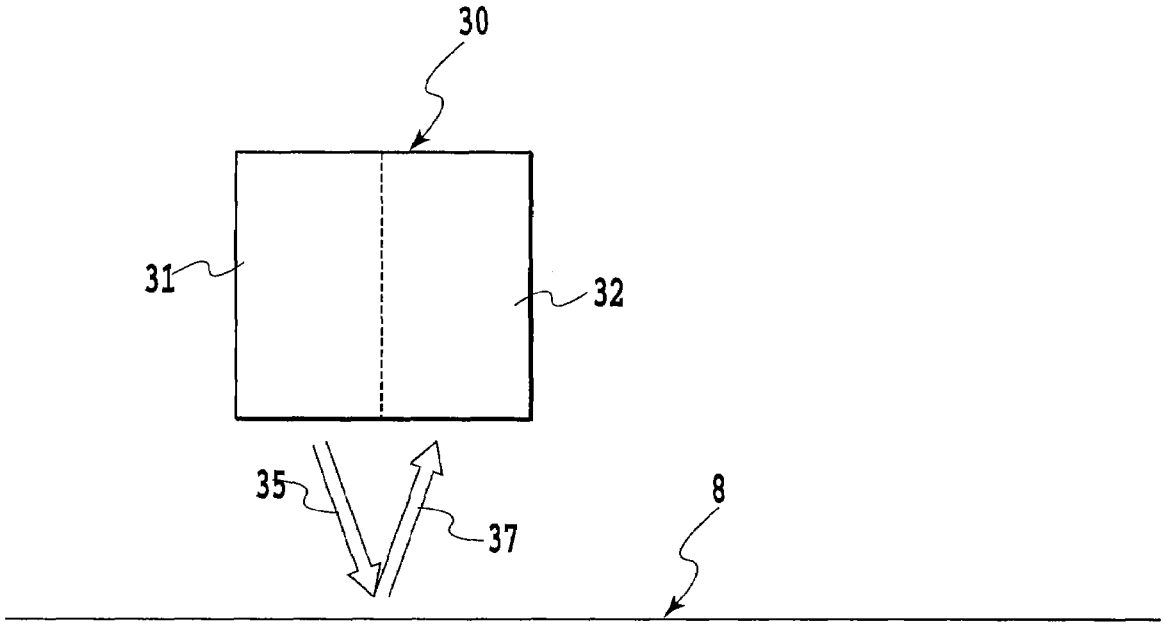
FIG. 9 is a diagram illustrating the positional relationship between the optical sensor and the printing medium shown in FIGS. 1 and 2

FIG. 9 is a schematic diagram illustrating the reflection type optical sensor 30, shown in FIGS. 1 and 2.

The reflection type optical sensor 30 has a light emitting section 31 and a light receiving section 32. The reflection type optical sensor 30 is attached to the carriage 2 as described above. A light (incident light Iin) emitted by the light emitting section 31 is reflected by the printing medium 8. The reflected light (Iref) 37 can be detected by the light receiving section 32. A detection signal (analog signal) for the reflected light 37 is transmitted to a control circuit on the electric circuit in the printing apparatus via a flexible cable (not shown) An A/D converter in the control circuit converts the detection signal into a digital signal. The position at which the optical sensor 30 is attached to the carriage 2 is set to be misaligned with respect to a movement track of the ejection openings of the print head H during a print scan, thus preventing the optical sensor from accreting of splash of ink and the like. The optical sensor 30 may have a relatively low resolution, thus reducing costs.

(1-6) Example of Configuration of Control Circuit

Figure 10:
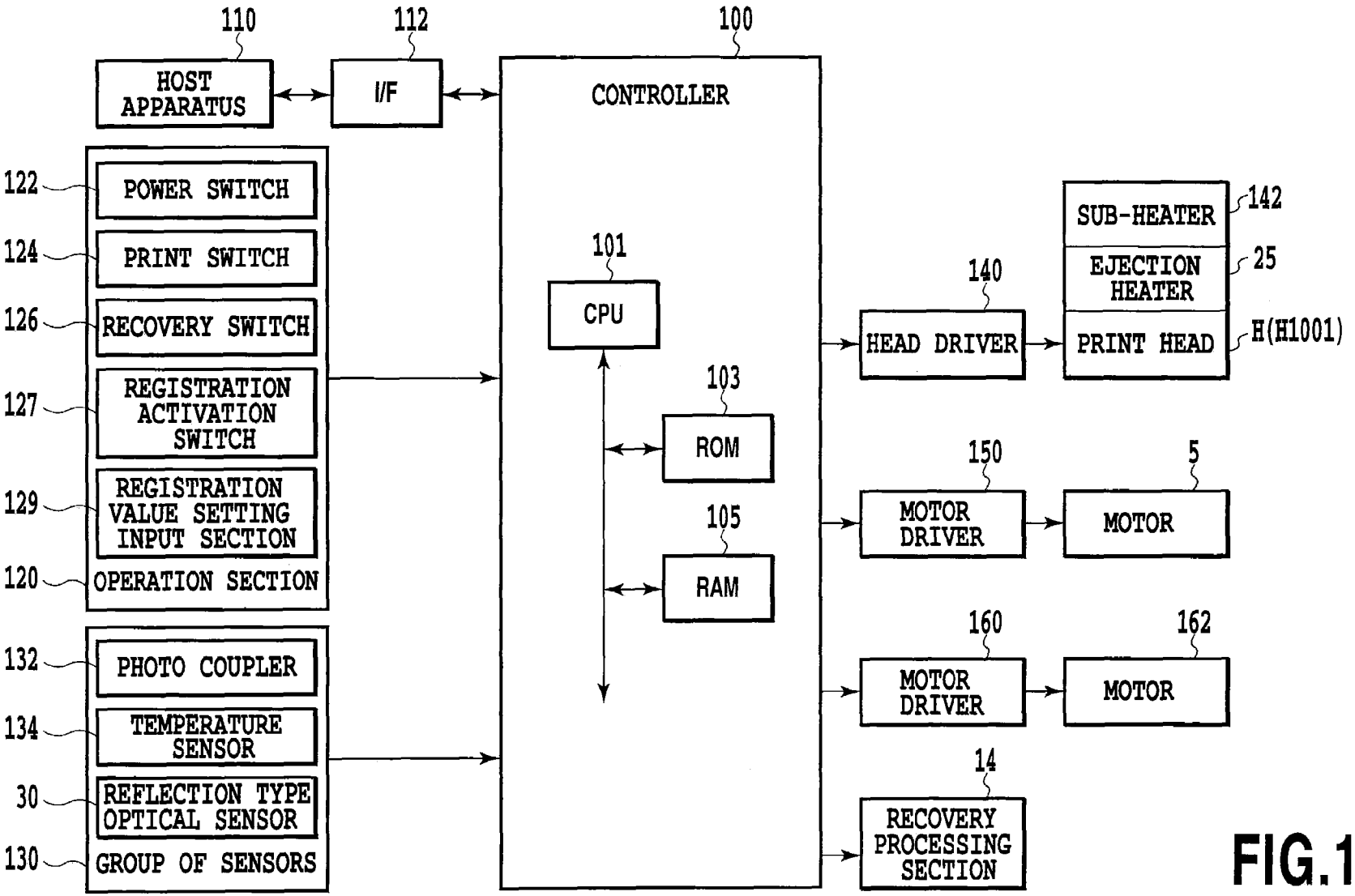
FIG. 10 is a block diagram of a control system in the ink jet printing apparatus shown in FIGS. 1 and 2.

FIG. 10 is a block diagram illustrating an example of the configuration of a control circuit in the ink jet printing apparatus.

In FIG. 10, a controller 100 operating as a main control section has a CPU 101 in the form of, form example, a microcomputer, a ROM 103 that stores programs, required tables, and other fixed data, and a RAM 105 provided with an area in which image data is expanded, a work area, and the like. The CPU 101 executes a process for print registration (print position adjustment), described later. The process for print registration (print position adjustment) sets adjustment values for print position adjustment. The adjustment values lend themselves to the adjustment of print positions used during the subsequent actual printing process. A host device 110 is a source of image data and may be in the form of a computer that for example, creates and processes data on printing such as images, a reader section for reading images, or the like. Image data, other commands, status signals, or the like are transmitted to and received from a controller 100 via an interface (I/F) 112.

An operation section 120 is a group of switches that receive instruction inputs from an operator and has switches 122, 124, 126, and 127, and input section 129, and the like. The switch 122 is a power switch. The switch 124 instructs on starting of printing. The switch 126 is a recovery switch that instructs on activation of a suction recovery operation on the print head H (H1001). The switch 127 is a registration adjustment activation switch 127 for manual registration (print position adjustment). The input section 129 is a registration value setting input section used to input adjustment values for manual registration. A group of sensors 130 detects the state of the apparatus and includes the reflection type optical sensor 30, a photo coupler 132 that detects a home position, and a temperature sensor 134 provided in an appropriate area in order to detect ambient temperature.

A head driver 140 drives ejection heaters 25(*h*) in the print head 1 or 41 in accordance with print data or the like. The head driver 140 has a shift register that aligns print data in association with the positions of the ejection heaters 25(*h*), a latch circuit that executes latching at appropriate times, and a logical circuit element that operates the ejection heaters 25(*h*) synchronously with drive timing signals. Moreover, the head driver 140 has, for example, a timing setting section that appropriately sets drive timings (ejection timings) for dot formation registration. The print head 1 and 41 are provided with sub-heaters 142. The sub-heaters 142 adjust temperature in order to stabilize ink ejection characteristics. The sub-heaters 142 may be formed on the print head circuit board simultaneously with the ejection heaters 25(*h*) and/or may be attached to the print head main body or head cartridge. A motor driver 150 drives a main scanning motor 5. A sub-scanning motor 162 is used to convey the printing medium 8 (move it in the sub-scanning direction). A motor driver 160 drives the sub-scanning motor 162.

(1-7) Pint Registering Print Pattern

In the description below, the rate of a predetermined area on the printing medium taken up by an area printed by the printing apparatus is referred to as an "area factor". For example, if dots are formed all over a predetermined area on the printing medium, the area factor is 100%. If dots are not formed at all, the area factor is 0%. If the printed area is half the predetermined area, the area factor is 50%.

Figure 11A:
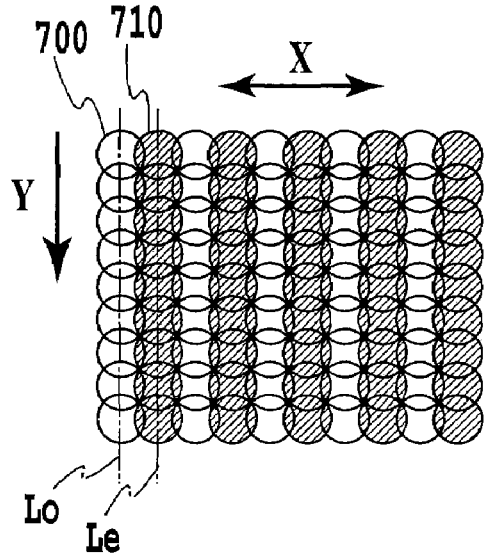
FIGS. 11A, 11B, and 11C are diagrams illustrating an example of a print position adjusting pattern.
Figure 11B:
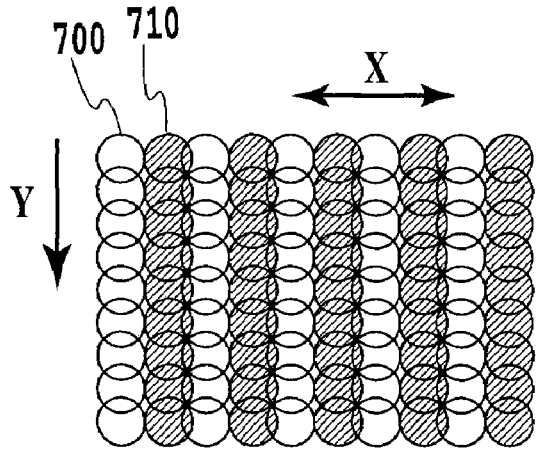
Figure 11C:
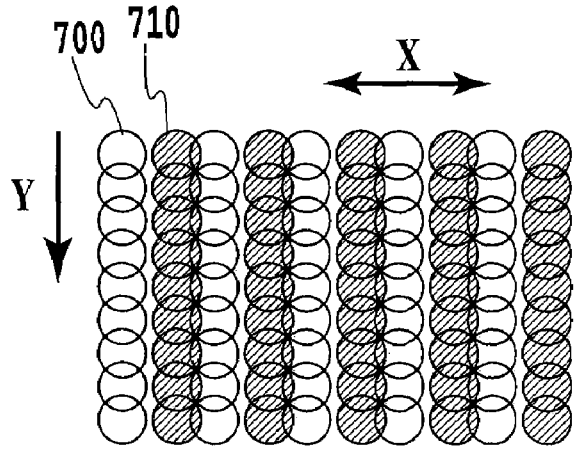

FIGS. 11A, 11B, and 11C are schematic views illustrating an example of a print pattern (print position adjusting pattern) for print registration. The print pattern in the present example allows the acquisition of print position adjustment values between the positions of dots formed (print positions) during forward printing (forward scan) and the positions of dots formed (print positions) during backward printing (backward scan) if bidirectional printing is to be implemented.

In FIGS. 11A, 11B, and 11C, white dots 700 are formed on the printing medium 8 during a forward scan (first print). Hatched dots 710 are formed during a backward scan (second print). The presence and absence of the hatching in the dots 700 and 710 are for the convenience of description. In the present example, the dots 700 and 710 are formed by the ink ejected from the same print head and do not correspond to the color or thickness of the dots. FIG. 11A shows dots formed when the print positions match between the forward scan and the backward scan. FIG. 11B shows dots formed when the print positions deviate slightly between the forward scan and the backward scan. FIG. 11C shows dots formed when the print positions deviate further between the forward scan and the backward scan.

As is apparent from FIGS. 11A, 11B, and 11C, in the present example, complementary dots are formed during the forward and backward scans. Specifically, the dots 700 in odd-number-th rows Lo are formed during the forward scan while the dots 710 in even-number-th rows Le are formed during the backward scan. Accordingly, when the dots 700 and 710 are printed so as to be misaligned with respect to each other by a distance substantially equal to the diameter of one dot, the print positions match between the forward scan and the backward scan. With this print pattern, the density of the entire printed part decreases with increasing deviation in print positions. That is, within the extent of a patch in which the print pattern in FIG. 11A is printed, the area factor is substantially 100%. As shown in FIGS. 11B and 11C, as the print positions deviate further between the forward scan and the backward scan, the size of the overlapping part between the dot 700 formed during the forward scan and the dot 710 formed during the backward scan increases. The area in which no dots are formed, that is, the area not covered with any dots increases. As a result, the area factor decreases to reduce the total average density.

In the present example, a print timing is shifted to gradually shift the print positions during the forward and backward scans to print a plurality of print registering print patterns. The print registering print patterns with the print patterns gradually shifted can be realized by shifting the positions of data on print data. In FIGS. 11A, 11B, and 11C, for both dots 700 and 710, 1 dot is formed at a time in the main scanning direction. However, the dots may be formed using an appropriate unit dot number in accordance with the accuracy of print registration or the like.

Figure 12A:
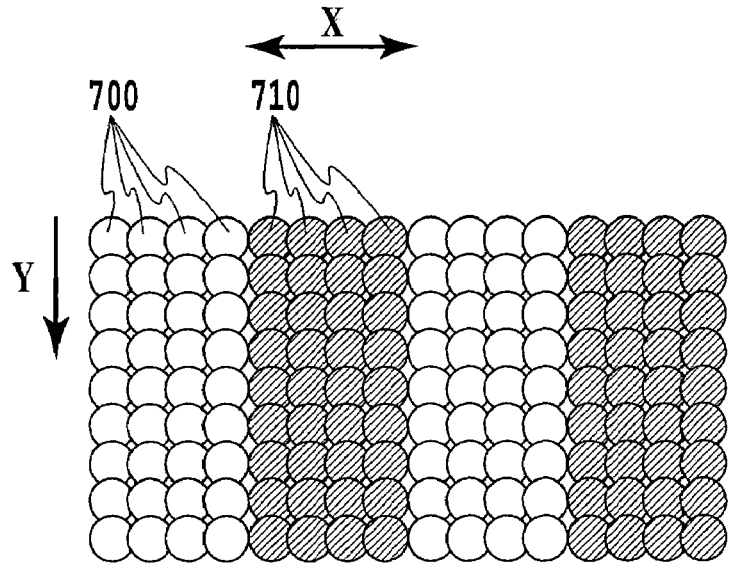
FIGS. 12A, 12B, and 12C are diagrams illustrating another example of a print postision adjusting pattern.
Figure 12B:
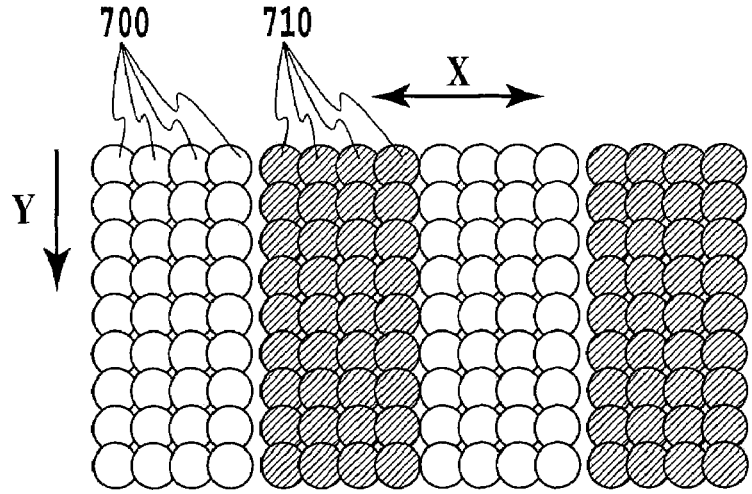
Figure 12C:
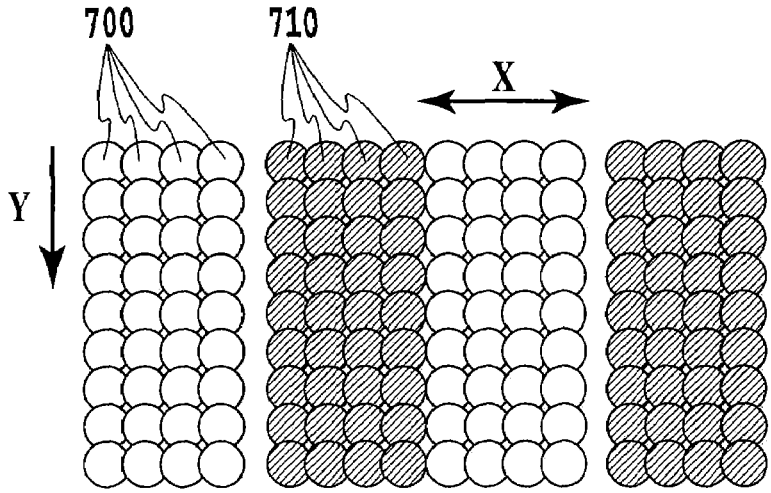

FIGS. 12A, 12B, and 12C are diagrams illustrating that for both dots 700 and 710, 4 dots are formed at a time.

FIG. 12A shows that the print positions match between the forward scan and the backward scan. FIG. 12B shows that the print positions deviate slightly between the forward scan and the backward scan. FIG. 12C shows that the print positions deviate further between the forward scan and the backward scan. These print patterns are intended to indicate that the area factor decreases as the dot print positions deviate further between the forward scan and the backward scan. This is because the density of the print area depends strongly on a variation in area factor. Specifically, if the dot print positions deviate between the forward scan and the backward scan, the average density of the entire print area is more affected by a decrease in density caused by an increase in the area in which no dots are printed than by an increase in the density resulting from the overlapping between the dots 700 and 710.

Figure 13:
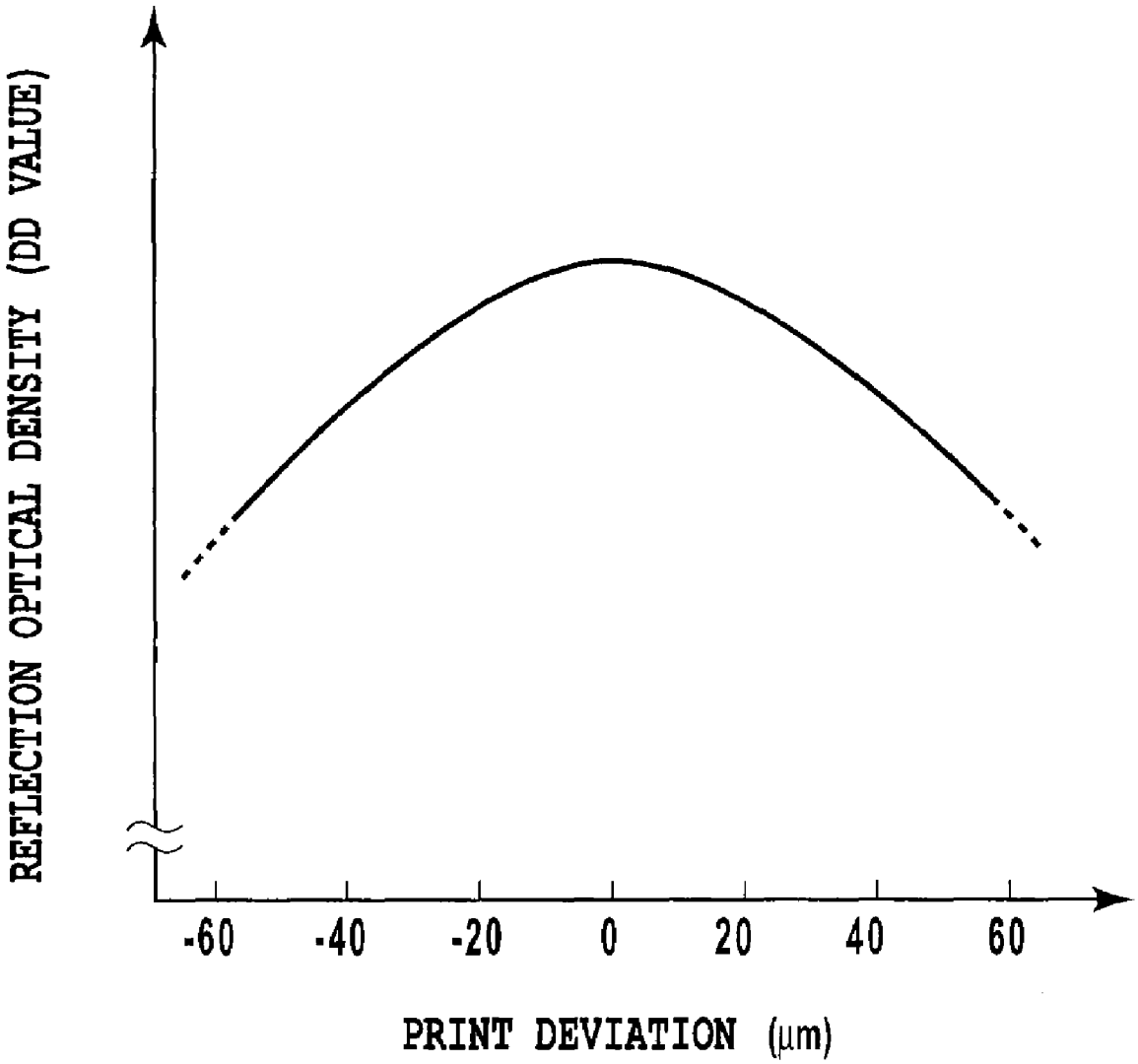
FIG. 13 is a diagram illustrating the relationship between the amount of deviation in print positions of the print position adjusting pattern and reflection optical density.

FIG. 13 is a graph illustrating the relationship between reflection optical density and the amount of deviation in print-positions in the print patterns shown in FIGS. 11A to 11C and 12A to 12C for the present embodiment.

In FIG. 13, the axis of ordinate indicates the reflection optical density (OD value), while the axis of abscissa indicates the amount of deviation in print positions (μm). If the incident light (Iin) 35 and reflected light (Iref) 37 in FIG. 9 are used, reflectance R is R=Iref/Iin and transmittance T is T=1−R. When the optical density is defined as d, there is a relationship R=10−d. As described above, when the amount of deviation in the print positions of the dots 700 and 710 is "0", the area factor is 100% and the reflectance R is minimized. That is, the reflection optical density d is maximized. The reflection optical density d decreases when the print positions of the dots 700 and 710 deviate either in a plus direction or in a minus direction (the direction of an arrow X in FIGS. 11 and 12).

(1-8) Process of Print Registration

Figure 14:
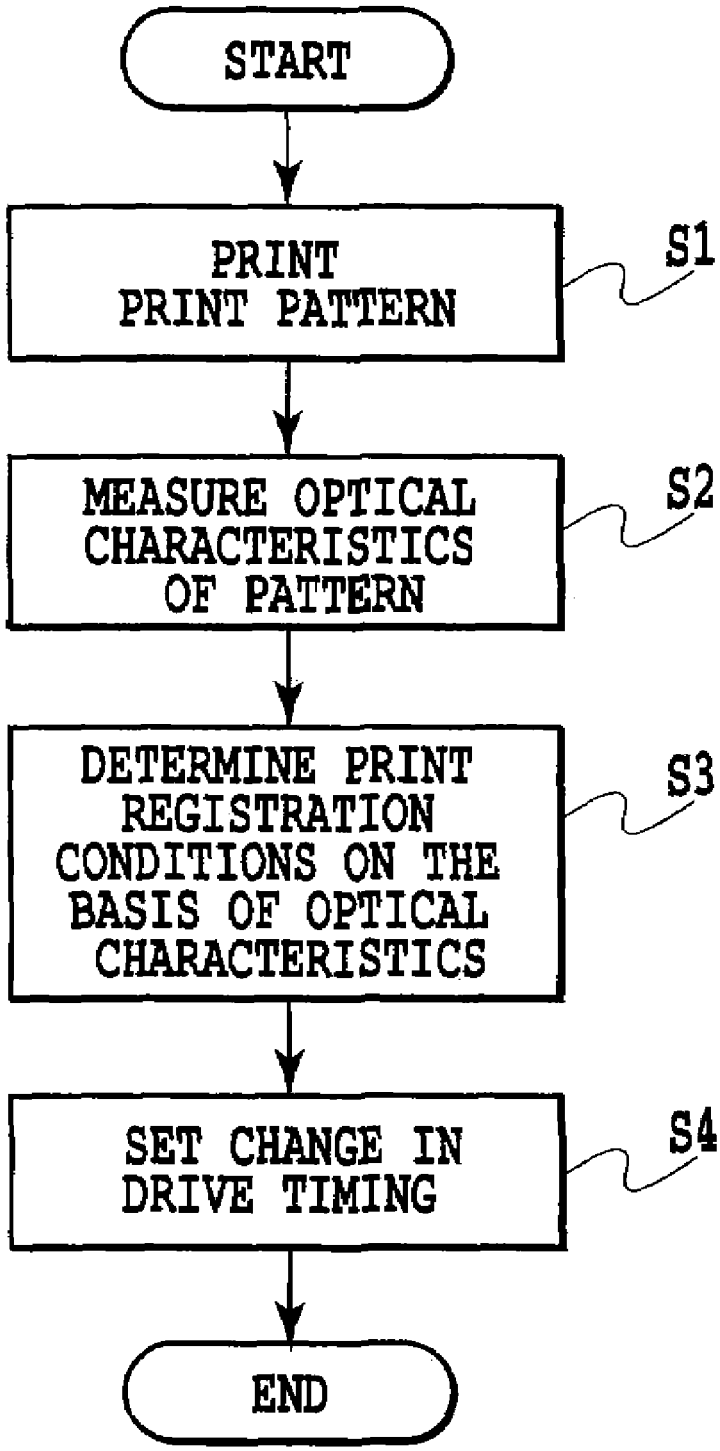
FIG. 14 is a flow chart illustrating a basic print position adjusting process.

FIG. 14 is a flow chart illustrating a process of print registration (print position adjusting process).

First, a print registering print pattern is printed (step S1). Then, the optical sensor 30 is used to measure the optical characteristics of the print pattern (step S2). On the basis of the measured optical characteristics of the print pattern, appropriate print registration conditions are determined (step S3). The registration conditions can also be determined by curve approximation. Then, print position parameters corresponding to the registration conditions are used to change drive timings for the print head to adjust dot formed positions (step S4).

Figure 15:
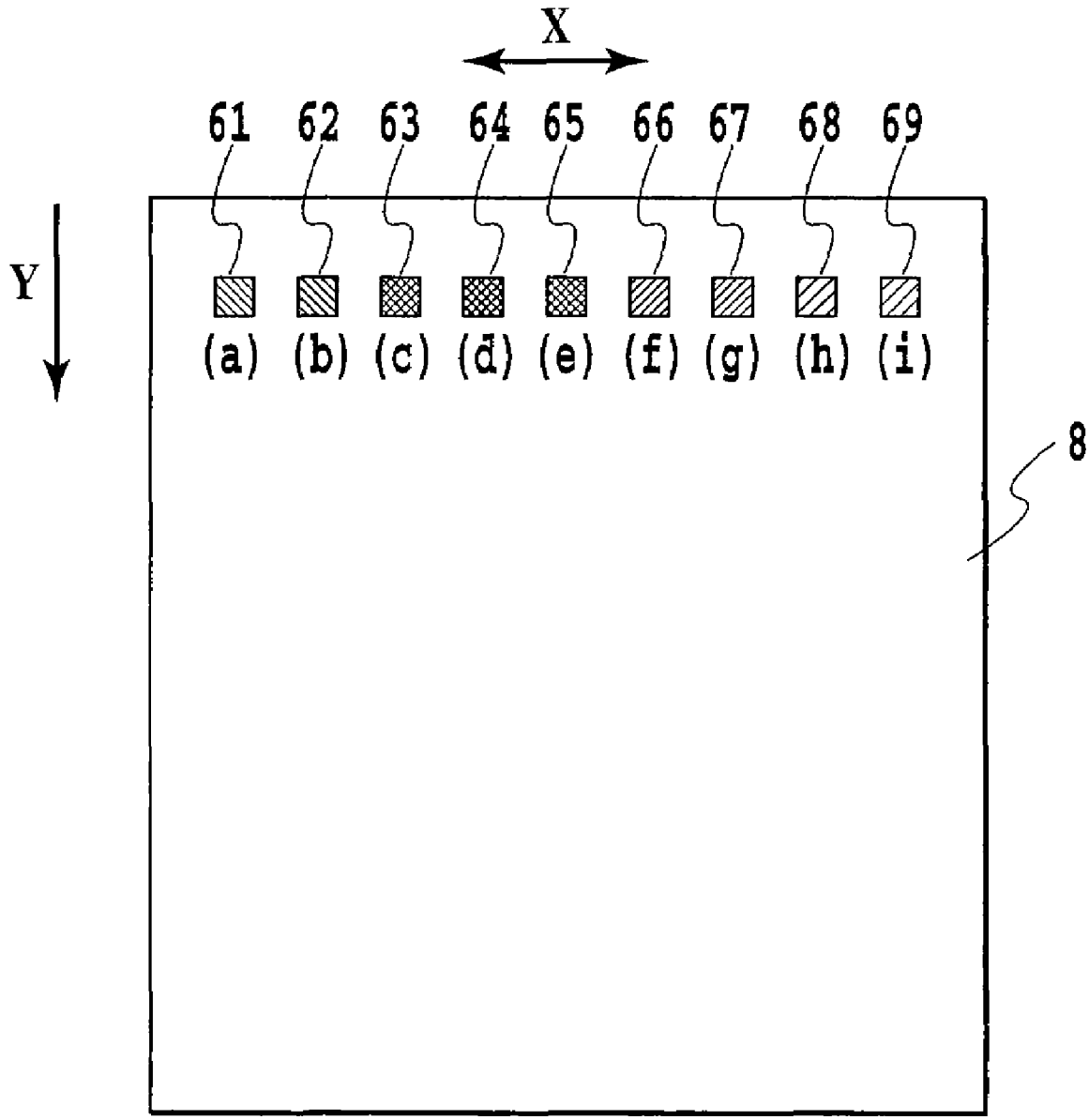
FIG. 15 is a diagram illustrating an example of the printed print position adjusting pattern.

FIG. 15 is a diagram illustrating that print patterns such as those shown in FIGS. 12A to 12C are printed on the printing medium 8.

In the present example, nine print patterns 61 to 69 are printed which have different amounts of relative deviation in print positions between the forward scan printing and the backward scan printing. The printed patterns are also called patches (patches 61 to 69). The print position parameters corresponding to the patches 61 to 69 are denoted by (a) to (i). With the nine patterns 61 to 69, one of the print start timings for the forward and backward scans, for example, the print start timing for the forward scan is fixed. On the other hand, there are nine timings for the backward scan including the currently set start timing, four-level start timings earlier than the currently set start timing, and four-level start timings later than the currently set start timing. A program activated by a predetermined instruction input can set these print start timings and print the nine patterns 61 to 69 on the basis of the print start timings.

After the patches 61 to 69 or the like have been printed as print patterns, the printing medium 8 and the carriage 2 are moved so that the optical sensor 30, mounted on the carriage 2, is placed opposite the print positions. Then, the carriage 2 is brought to a halt and the optical characteristics of the patches 61 to 69 or the like are measured. By thus measuring the optical characteristics while the carriage 2 is stationary, it is possible to avoid the adverse effect of noise resulting from driving of the carriage 2. Further, the size of a spot measured by the optical sensor 30 can be increased with respect to the diameter of the dots by increasing the distance between the sensor 30 and the printing medium 8. Thus, the reflection optical density can be accurately measured by averaging a local variation in the optical characteristics (for example, reflection optical density) on the printed patterns.

(2) Embodiment of Characteristic Configuration

Then, description will be given of an embodiment of the characteristic configuration of the present invention.

(2-1) Optical Sensor

The optical sensor 30 according to the present embodiment can emit an appropriately selected light depending on the tone of a print agent such as ink which is used in the printing apparatus, the configuration of the print head, or the like. For example, by using a red light emitting diode (LED) as the light emitting section 31 and using a print agent that excellently absorbs an emitted red light, it is possible to subject a print head applying this print agent to print registration.

Figure 16A:
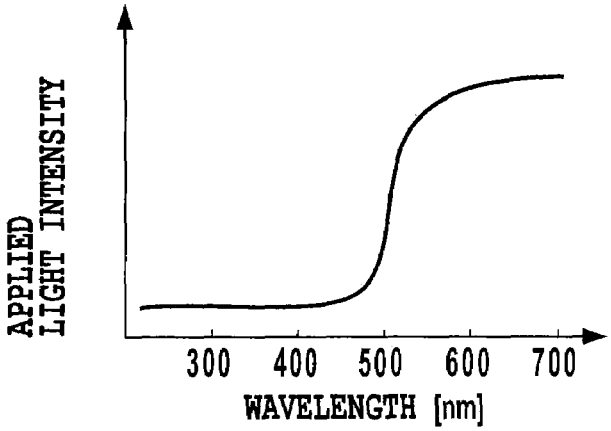
FIGS. 16A, 16B, 16C, and 16D are graphs illustrating the relationship between the characteristics of an optical sensor used in an embodiment of the present invention and a part of a printing medium in which no dots are formed.

With reference to FIGS. 16A. 16B, 16C, and 16D, description will be given below of the principle of measurement utilizing the optical characteristics of light applied by the light emitting section 31.

Figure 16B:
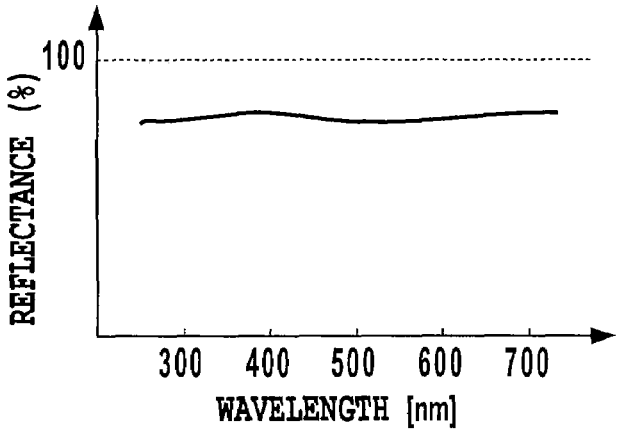
Figure 16C:
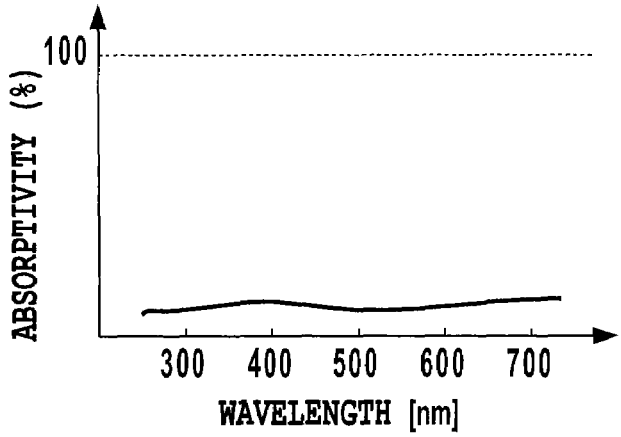
Figure 16D:
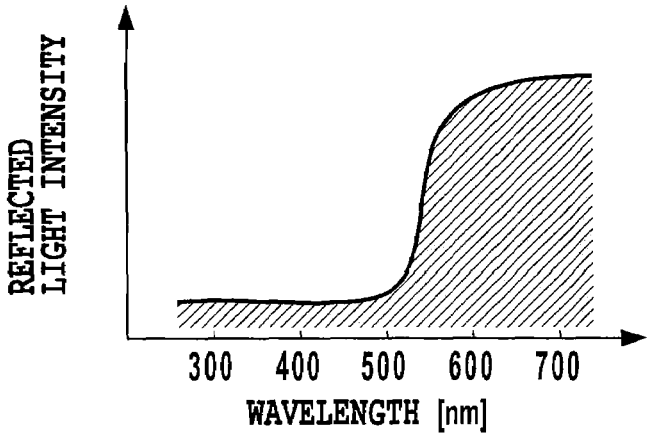
Figure 17A:
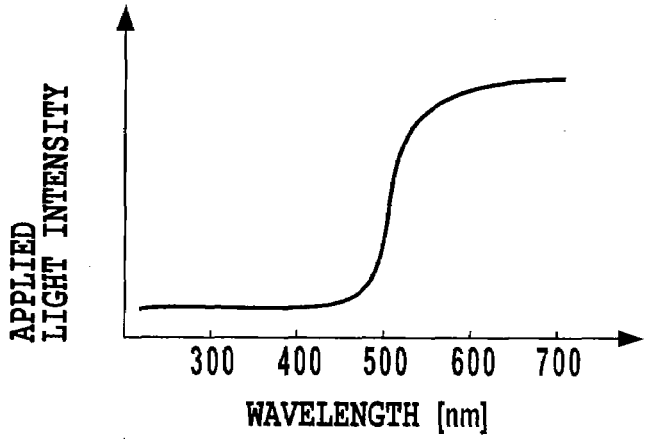
FIGS. 17A, 17B, 17C, and 17D are graphs illustrating the relationship between the characteristics of the optical sensor used in the embodiment of the present invention and a part of the printing medium in which black dots are formed.
Figure 17B:
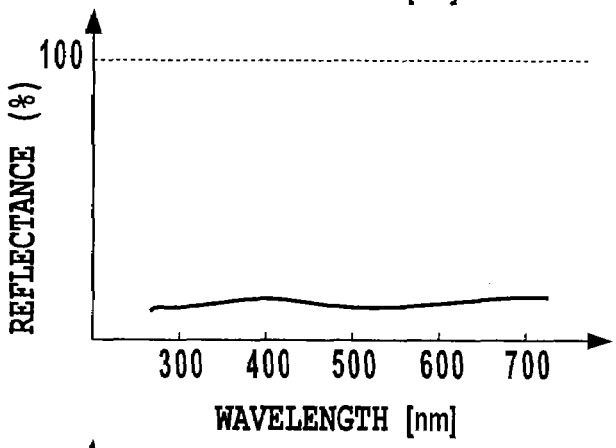
Figure 17C:
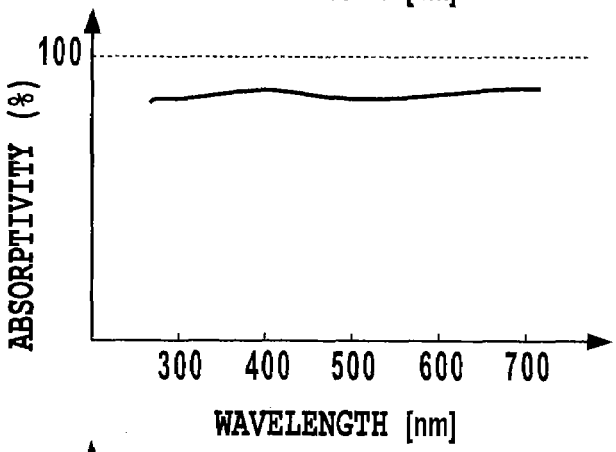
Figure 17D:
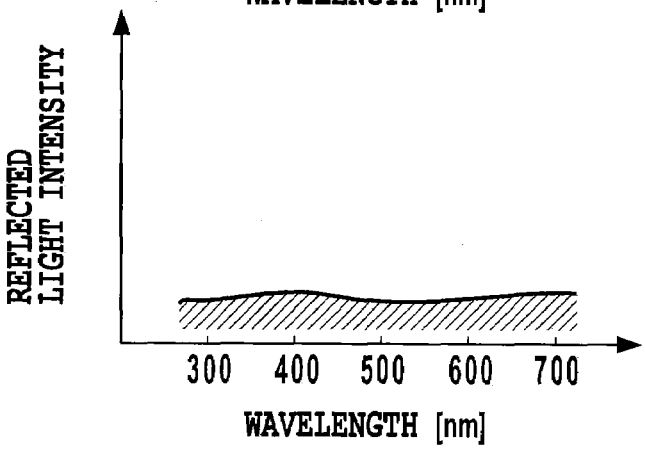
Figure 18A:
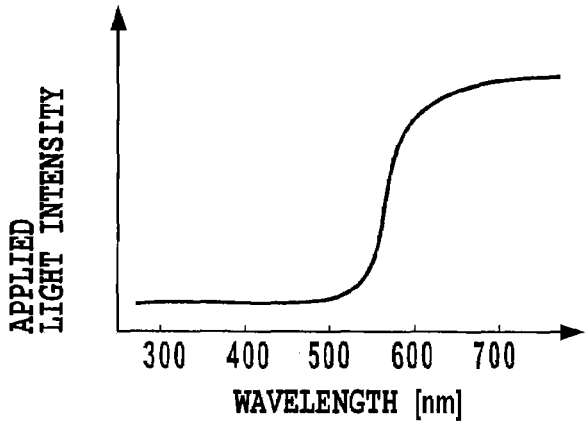
FIGS. 18A, 18B, 18C, and 18D are graphs illustrating the relationship between the characteristics of the optical sensor used in the embodiment of the present invention and a part of the printing medium in which cyan dots are formed.
Figure 18B:
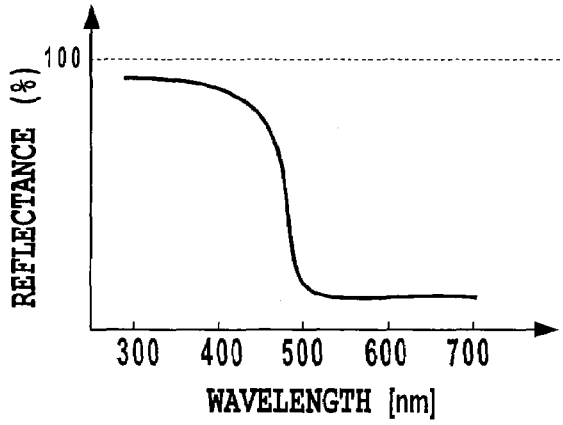
Figure 18C:
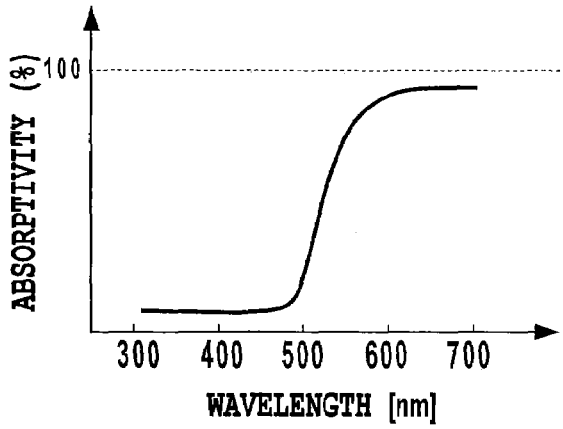
Figure 18D:
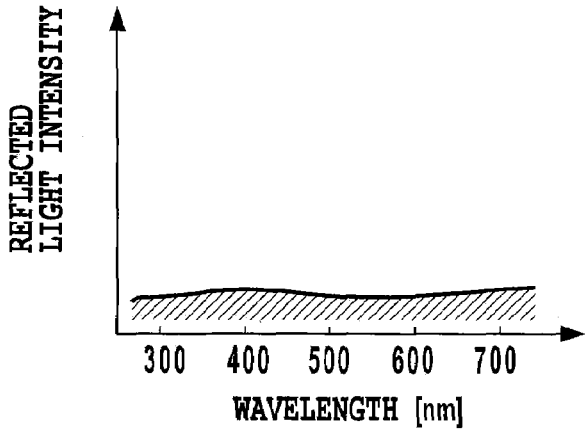

FIG. 16A shows the color wavelength characteristic of a red light emitting diode as the light emitting section 31. This figure indicates the color of the light source and the intensity of light. In FIG. 16A, roughly speaking, blue corresponds to the vicinity of a wavelength of 450 nm. Green corresponds to the vicinity of a wavelength of 550 nm. Red corresponds to the vicinity of a wavelength of 610 nm. FIG. 16B shows the wavelength characteristic of the reflectance of the printing medium on which no dots are formed. This characteristic is attributed to the color of the part of the printing medium in which no dots are formed. FIG. 16C shows the wavelength characteristic of the optical absorptivity of the printing medium on which no dots are formed. This optical absorptivity is obtained by subtracting the reflectance shown in FIG. 16B from 100%. Like the characteristic shown in FIG. 16B, the characteristic shown in FIG. 16C is attributed to the color of the part of the printing medium in which no dots are formed. FIG. 16D shows the wavelength characteristic of a reflected light from the printing medium. This characteristic indicates the relationship between the color of the reflected light and the intensity of the light.

The printing medium used in the present embodiment has a high reflectance all over a visible region as shown in FIGS. 16B and 16C. The printing medium thus has a low optical absorptivity. Accordingly, for the optical characteristics of the reflected light shown in FIG. 16D, the intensity of the light decreases slightly because the printing medium absorbs the light. However, roughly speaking, the wavelength characteristics do not change significantly. A shaded portion of FIG. 16D indicates a part that contributes to measurement outputs from a measuring element that measures the intensity of the light (which covers the visible region). Actually, the measurement output for the intensity of light is affected by the sensitivity characteristic of the measuring element. However, for a plain description, the area of the shaded portion of FIG. 16 is assumed to correspond directly to the measurements of the optical sensor.

FIGS. 17A to 20D are graphs illustrating the measurements of a part of the printing medium in which dots the black, cyan, magenta, or yellow ink (print agent) are formed.

FIGS. 17B, 18B, 19B, and 20B show the wavelength characteristic of the reflectance of the part of the printing medium in which dots are formed using the ink of each color (black, cyan, magenta, and yellow). This characteristic is attributed to the coloring of the part in which dots are formed using the ink of each color. FIGS. 17*c*, 18*c*, 19*c*, and 20*c* show the wavelength characteristic of the absorptivity of the part of the printing medium in which dots are formed using the ink of each color. This optical absorptivity is obtained by subtracting the reflectance shown in FIGS. 17B, 18B, 19B, and 20B from 100%. Like eke characteristic shown in FIGS. 17B, 18B, 19B, and 20B, the characteristic shown in FIG. 17C, 18C, 19C, and 20C is attributed to the coloring of the part of the printing medium in which dots are formed using the ink of each color. FIGS. 17D, 18D, 19D, and 20D show the wavelength characteristic of a reflected light from the printing medium. These figures indicate the relationship between the color of the reflected light and the intensity of the light.

Figure 19A:
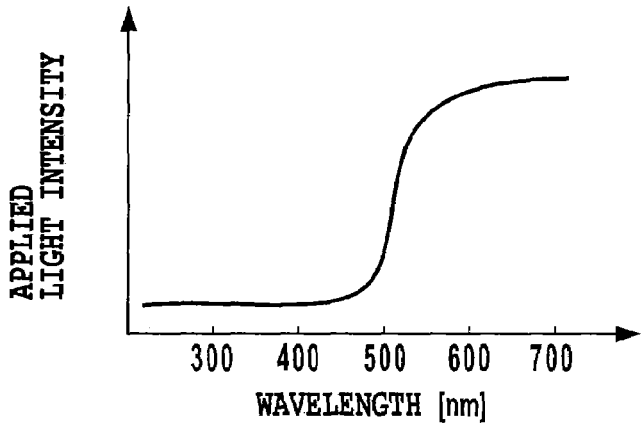
FIGS. 19A, 19B, 19C, and 19D are graphs illustrating the relationship between the characteristics of the optical sensor used in the embodiment of the present invention and a part of the printing medium in which magenta dots are formed.
Figure 19B:
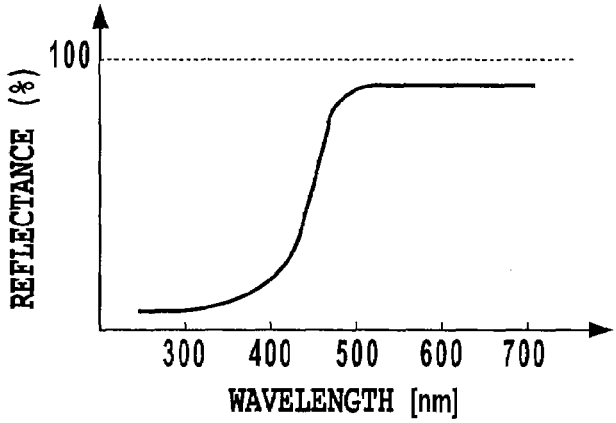
Figure 19C:
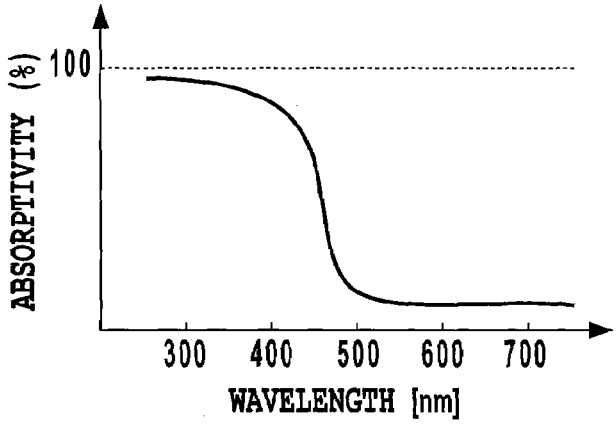
Figure 19D:
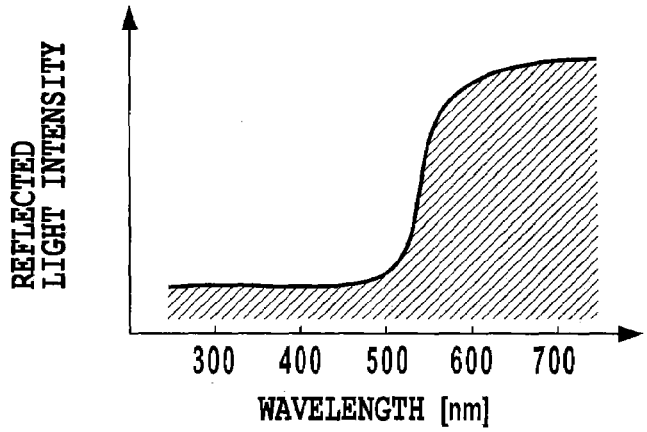
Figure 20A:
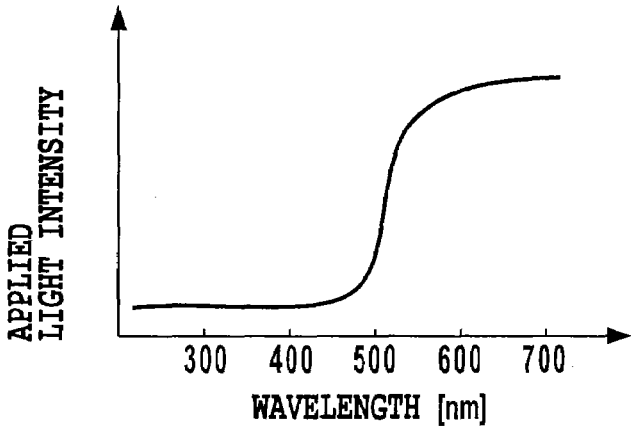
FIGS. 20A, 20B, 20C, and 20D are graphs illustrating the relationship between the characteristics of the optical sensor used in the embodiment of the present invention and a part of the printing medium in which yellow dots are formed.
Figure 20B:
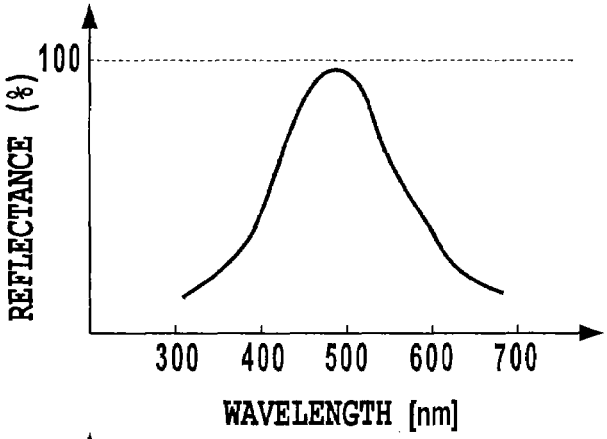
Figure 20C:
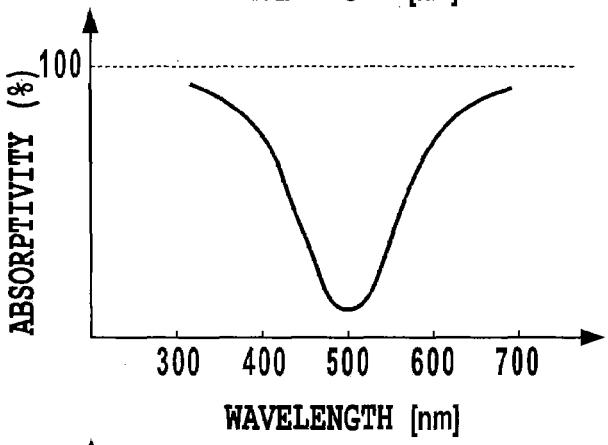
Figure 20D:
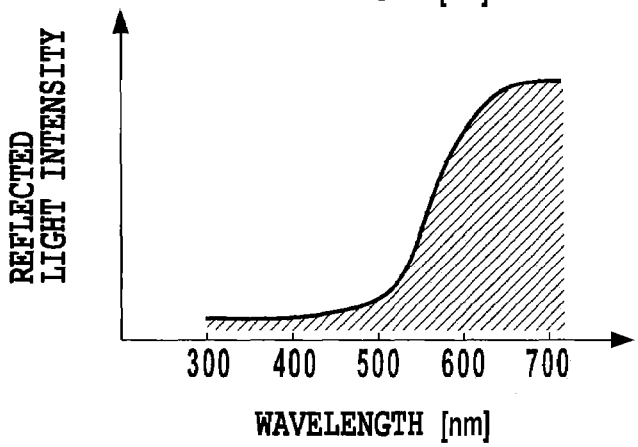

In the case of the yellow ink dots, the reflectance has a peak in the vicinity of the wavelength corresponding to their tone as shown in FIG. 20B. In contrast, as shown in FIG. 20C, the absorptivity is high in the visible region except for the wavelength corresponding to the tone. Further, in the vicinity of a wavelength of 610 nm, which corresponds to a red region, the intensity of reflected lights from the dots of the magenta and yellow inks is high (as shown in FIGS. 19D and 20D) in a region in which lights from the dots of the black and cyan inks are absorbed favorably (as shown in FIGS. 19D and 20D).

A comparison of the shaded portions of FIGS. 16D, 17D, 18D, 19D, and 20D indicates that the largest quantity of light is reflected if no dots are formed on the printing medium (see FIG. 16D). In contrast, a reduced quantity of light is reflected if dots of the black or cyan ink are formed on the printing medium (see FIGS. 17D and 18D). The reason why a large quantity of light is reflected by dots of the yellow ink is that the wavelength portion corresponding to yellow has a wavelength region with a low absorptivity or a high reflectance. This characteristic is attributed to the optical characteristics of light from the yellow ink permeating through and fixed to the printing medium. This also applies to the magenta ink.

These characteristics were utilized to measure the reflection optical density of the part in which no ink dots were formed and the part in which dots of each color were formed. Then, the difference in output was determined. As a result, the output difference was small when measurements were made of the reflection optical density of the part in which no ink dots were formed and of the part in which dots of yellow or magenta inks were formed. This is because an increased quantity of light is reflected from the part in which dots of the yellow or magenta inks are formed, thus reducing the difference between this quantity and the quantity of light reflected from the part in which no dots are formed (see FIG. 16D), as shown in FIGS. 19D and 20D. In this manner, with a light emitting section that applies a light of a predetermined wavelength, when measurements are made of the reflection optical density of the part in which no ink dots are formed and of the part in which ink dots are formed, the difference in outputs from the optical sensor may be small.

(2-2) Method of Print Registration

In the present embodiment, a method of print registration (a method of adjusting print positions) is based on print positions during first printing (in the previously described example of the basic configuration, the print positions during the forward scan) and print positions during second printing (in the previously described example of the basic configuration, the print positions during the backward scan).

First, a plurality of print patterns (print position adjusting patterns) are printed which have different amounts of deviation in print positions between the first printing and the second printing. Subsequently, the optical sensor 30 is used to measure the optical characteristics of each pattern, for example, the reflection density of each print pattern. Then, on the basis of the measurements, print position conditions are set. That is, one of the plurality of printed print patterns is automatically selected which has the optimum relationship between the print positions during the first printing and the print positions during the second printing. Then, the print conditions for the selected print pattern are set as print position conditions. The print position conditions are utilized as print position adjustment values for the subsequent print operation. That is, the ink ejection timings, the amount of ink ejected, and the like are automatically adjusted on the basis of the print conditions. This enables printing without print misalignment.

With such a method of print registration, the measurements of the optical sensor 30 may vary depending on the types of ink. Thus, if there is only a small contrast between the part of the printing medium in which dots are formed and the part of the printing medium in which no dots are formed, it cannot be accurately sensed by the optical sensor 30. As a result, it may be difficult to achieve accurate print registration. For example, if the print positions during the first and second printing undergo registration and a plurality of print patterns having different amounts of deviation in print positions are printed, the problems described below may occur. There is not a large difference in measured reflection optical density between a part of the front surface of the printing medium in which no dots of the yellow ink are formed and a part of the front surface of the printing medium which is covered with dots formed during the first printing (forward scan) using the yellow ink and dots formed during the second printing (backward scan) using the same yellow ink. Thus, it is difficult to accurately detect the deviation in the positions of dots of the yellow ink. For example, in the first and second cases described below, there is only a small difference in the measurement of the intensity of reflected light detected by the optical sensor 30.

In the first case, the print positions deviate relatively between the first printing and the second printing. Consequently, dots of the yellow ink formed during the forward and backward scans overlap each other so that in some parts of the front surface of the patch on the printing medium, no dots of the yellow ink are formed (parts with a reduced reflection optical density). In the second case, the front surface of the printing medium is covered with dots formed during the first and second printing using the yellow ink. Consequently, the amount of variation in the measurements of the optical characteristics such as the reflection density is decreased with respect to the amount of deviation in the print positions between the first printing and the second printing. Therefore, it may be difficult to accurately measure the print positions.

Thus, in the present embodiment, to solve this problem, a particular print agent (ink) is used for print registration That is, a predetermined print head does not undergo print registration. The predetermined print head uses an ink (print agent) of a tone that reduces the amount of variation in measurements of the optical characteristics such as the reflection density, with respect to the amount of deviation in print positions between the first printing and the second printing. That is, the print head uses an ink of a tone that makes it difficult to accurately measure the print positions. For this print head, print registration is executed by using print registration adjustment values (print position adjustment values) for a print head ejecting another color ink. Specifically, print registration adjustment values (print position adjustment values) are substituted which relate to a print head using an ink (print agent) that increases the amount of variation in measurements of the optical characteristics with respect to the amount of deviation in print positions between the first printing and the second printing, that is, a print head using an ink of a tone that enables the print positions to be accurately measured. Thus, in the present embodiment, print position adjustment values for a print agent that can be relatively accurately detected by the optical sensor (for example, the black ink) are substituted for print position adjustment values for a print agent that can be relatively inaccurately detected by the optical sensor (for example, the yellow ink).

It can be determined as described below whether a print agent can be relatively in accurately or accurately detected by the optical sensor. A difference in the results of detection by the optical sensor between an area on the printing medium in which no patterns are printed and an area on the printing medium in which a pattern is printed is determined. If the difference is equal to or smaller than a predetermined value, it can be determined that the print agent printing the pattern can be relatively inaccurately detected. Print registration adjustment values based on the printing results of a pattern by an ink that can be relatively inaccurately detected may be set as print registration adjustment values based on the printing results of a pattern by a different ink. The results of detection by the optical sensor may be the quantity of light received measured by the light receiving element of the optical sensor or a digital signal into which the quantity of light received is converted.

Now, a specific description will be given of a method of print registration executed if the print head in FIG. 7, previously described, is used.

In the present embodiment, a red light emitting diode (LED) is used as the light emitting section 31 of the optical sensor 30. Thus, in connection with the previously described wavelength characteristic, a print registering print pattern is printed using the black (Bk), cyan (C), or light cyan (LC) ink. If the magenta (M), light magenta (LM), or yellow (Y) ink is used, it is difficult to obtain a sufficient density characteristic and S/N ratio for the amount of deviation in print positions between the first printing and the second printing.

FIGS. 21A, 21B, and 21C are tables illustrating item numbers (A to H) of adjustment items for the printing apparatus according to the present embodiment, chip numbers (1 to 3), ink color agents (ink colors), nozzle line names, the characteristics of ejection of the ink from each nozzle line (the amount of ink ejected and ejection speed), and the possibility of print registration. The position adjustment items for the print head in FIG. 7, using six color inks (print agents), include the odd-even row adjustment (adjustment for printing positions of odd-number-th nozzle row and even number-th nozzle row) shown in FIG. 2 1A, the bidirectional adjustment (adjustment for printing positions in forward printing and backward printing) shown in FIG. 21B, and the chip adjustment (adjustment for printing positions of different tips) shown in FIG. 21C.

The odd-even row adjustment (item numbers A to F) is print registration between two ejection opening rows corresponding to each ink color. For the cyan ink, C1 denotes an even row and C2 denotes an odd row. With the odd-even row adjustment, the first printing is carried out using the ink ejected from the ejection openings P in the odd row. The second printing is carried out using the ink ejected from the ejection openings P in the even row. A plurality of print patterns having slightly different amounts of deviation in print positions between the first printing and the second printing are printed as patches such as the one shown in FIG. 15. The optical sensor 30 is then used to sense the print patterns.

The bidirectional adjustment (item numbers G to L) is print registration between the print positions during the forward scan (forward printing) and the backward scan (backward printing), that is, print position adjustment used if bidirectional printing is executed by scanning the print head in the forward and backward directions. For example, for the cyan ink, the registration between the forward scan and the backward scan can be accomplished by using the ejection openings P in the C1 (even) row both for the forward scan and for the backward scan. In the bidirectional adjustment, printing during the forward scan and printing during the backward scan are referred to as the first printing and the second printing, respectively. Then, a plurality of print patterns having different amounts of deviation in print positions between the first printing and the second printing are printed as patches such as the one shown in FIG. 15. The optical sensor 30 is then used to sense the print patterns.

The chip adjustment (items G and H) is print registration between chips 1 and 2 and 3 (FIG. 7). In the chip adjustment, printing using the chip 1 (chip number 1) and printing using the chip 2 (chip number 2) are referred to as the first printing and second printing, respectively. Further, printing using the chip 2 (chip number 2) and printing using the chip 3 (chip number 3) are referred to as the first printing and second printing, respectively. Then, a plurality of print patterns having different amounts of deviation in print positions between the first printing and the second printing are printed as patches such as the one shown in FIG. 15. The optical sensor 30 is then used to sense the print patterns.

The print heads according to the present embodiment are designed to exhibit substantially equal ejection characteristics (the quantity of ink ejected and the ejection speed) for all the ink colors. Further, the print head is formed by combining a plurality of (in the present embodiment, three) chips 1, 2, and 3 together. Thus, the ejection characteristics tend to vary markedly among the chips owing to the accuracy with which the chips are mounted, the amount of variation in heater size among the chips, and the like. The print heads within the same chip can at least avoid suffering these adverse effects, thus providing stable ejection characteristics.

As previously described, in connection with the wavelength characteristic of the red light emitting diode used as the light emitting section 31 of the optical sensor 30, three color inks (print agents), that is, the cyan, light cyan, and black inks can undergo print registration. The magenta, light magenta, and yellow inks cannot provide a sufficient density characteristic or S/N ratio with respect to the amount of deviation in print positions between the first printing and the second printing.

Accordingly, for adjustment items for the print head using the inks that cannot undergo the process of print registration, adjustment values for another print head that meets predetermined conditions are substituted. Specifically, s shown in FIGS. 22A and 22B, the present embodiment substitutes adjustment values for a print head which uses an ink on which a print registering process can be executed and which exhibits substantially equal ink ejection characteristics. For example, for the odd-even row adjustment of the print head for the light magenta ink with the item number B, adjustment values for the print head for the cyan ink (item number A), located within the same chip and exhibiting substantially equal ejection characteristics, are substituted. Likewise, for the bidirectional adjustment of the print head for the yellow ink with the item number J, adjustment values for the print head for the black ink (item number I) within the same chip are substituted.

(3) Another Embodiment of Characteristic Configuration

Now, description will be given of other embodiments of the characteristic configuration of the present invention.

Figure 23:
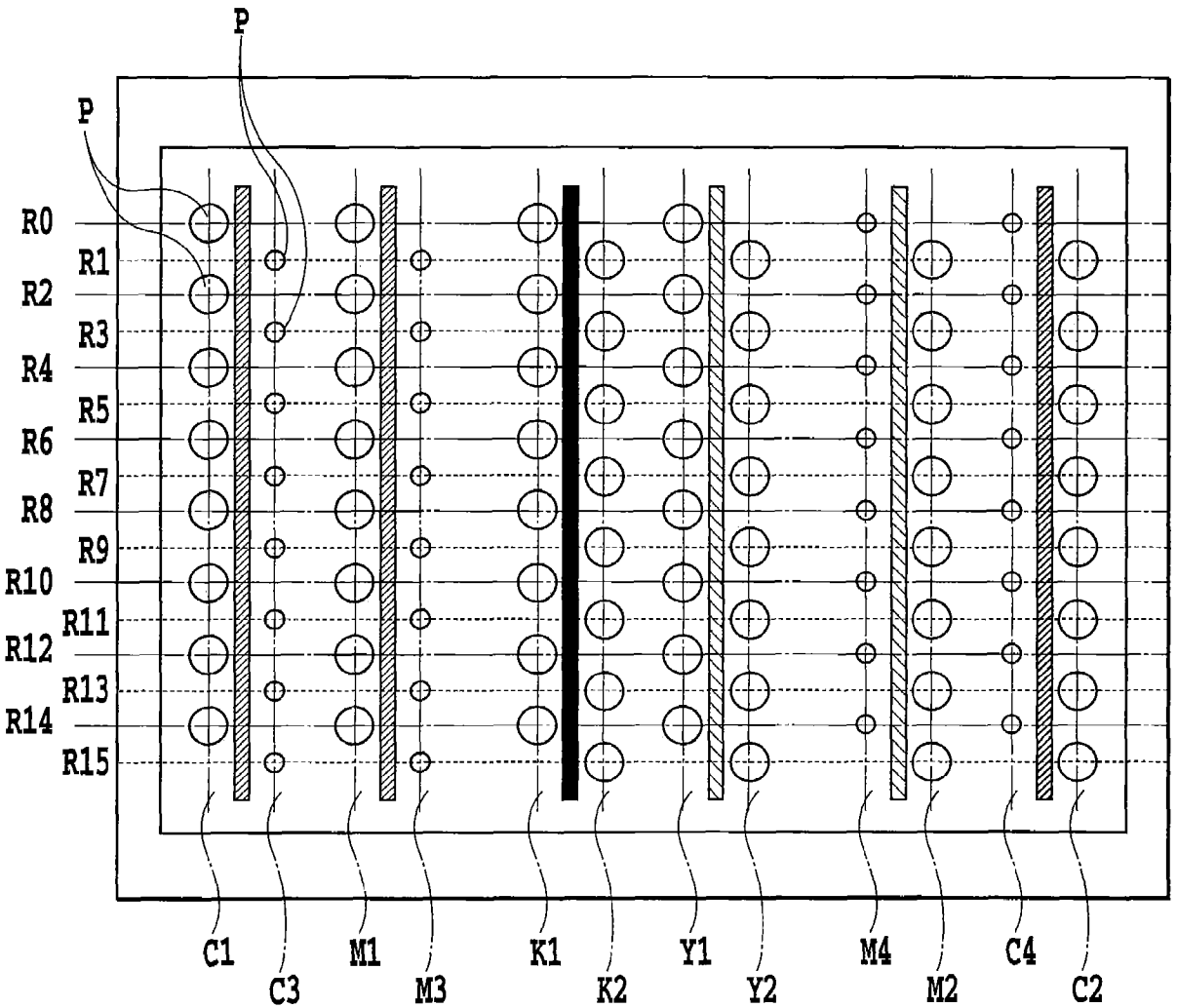
FIG. 23 is a bottom view of essential parts of a print head used in another embodiment of the present invention.

In the present invention, the process of substituting adjustment values can also be applied to a print head configured as shown in FIG. 23, as previously described in the embodiment. In the print head according to the present embodiment, nozzle rows corresponding to the cyan, magenta, yellow, and black inks (print agents) are arranged on the same chip in parallel. Further, the ejection openings P for the cyan ink include those which are located on nozzle rows C1 and C2 to eject (apply) a relatively large amount of ink and those which are located on nozzle rows C3 and C4 to eject (apply) a relatively small amount of ink. Similarly the ejection openings P for the magenta ink include those which are located on nozzle rows M1 and M2 to eject (apply) a relatively large amount of ink and those which are located on nozzle rows M3 and M4 to eject (apply) a relatively small amount of ink. Between the nozzles thus ejecting different amounts of ink, the area of the electrothermal converter (heater) and the area of the ejection opening vary.

FIGS. 24A, 24B, and 24C are tables illustrating item numbers (A to N) of adjustment items for the print head according to the present embodiment, ink color agents (ink colors), nozzle row names, the characteristics of ejection of the ink from each nozzle row (the amount of ink ejected and ejection speed) and the possibility of print registration. The position adjustment items for the print head in FIG. 23, using four color inks (print agents), include the odd-even row adjustment shown in FIG. 24A, the bidirectional adjustment shown in FIG. 24B, and the large/small nozzle row adjustment shown in FIG. 24C. The adjustment items A to F correspond to the odd-even row adjustment for each color. The adjustment items G to L correspond to the bidirectional adjustment for each color. The adjustment items M and N correspond to the large/small nozzle row adjustment.

The odd-even row adjustment and the bidirectional adjustment are similar to those described in the above embodiment. Further, the large/small nozzle row adjustment (item numbers M and N) is print registration between the nozzle rows C1 and C3, ejecting different amounts of cyan ink, and between the nozzle rows M1 and M3, ejecting different amounts of magenta ink. With the large/small nozzle row adjustment, printing with the nozzle row C1 and printing with the nozzle row C3 are referred to as the first printing and the second printing, respectively. Printing with the nozzle row M1 and printing with the nozzle row M3 are referred to as the first printing and the second printing, respectively. A plurality of print patterns having slightly different amounts of deviation in print positions between the first printing and the second printing are printed as patches such as the one shown in FIG. 15. The optical sensor 30 is then used to sense the print patterns.

The print head according to the present embodiment is designed so that the nozzle rows for the cyan and magenta inks eject different amounts of ink and that the nozzle rows ejecting the same amount of ink exhibit substantially equal ejection characteristics. Further, the print head according to the present embodiment is composed of a single chip. Accordingly, there is only a small variation in ejection capability between the nozzle rows within the same chip, thus providing stable ejection characteristics.

As previously described, in connection with the wavelength characteristic of the red light emitting diode, used as the light emitting section 31 of the optical sensor 30, two color inks (print agents), that is, the cyan and black inks can undergo print registration. The magenta and yellow inks cannot provide a sufficient density characteristic or S/N ratio with respect to the amount of deviation in print positions between the first printing and the second printing.

Accordingly, for adjustment items for the print head using the inks that cannot undergo the process of print registration, adjustment values for another print head that meets predetermined conditions are substituted as shown in FIGS. 25A, 25B, and 25C. Specifically, as shown in FIGS. 25A, 25B, and 25C, the present embodiment substitutes adjustment values for a print head which uses an ink on which a print registering process can be executed and which exhibits substantially equal ink ejection characteristics. For example, for the odd-even row adjustment for magenta (large) with the item number b, adjustment values for cyan (large) (item number A), located within the same chip and exhibiting substantially equal ejection characteristics, are substituted. Likewise, for the bidirectional adjustment of magenta (small) with the item number J, adjustment values for cyan (small) (item number H) within the same chip are substituted.

Other Embodiments

The present invention does not particularly limit the type of print agent or print system or the configuration of the print head or printing apparatus. For example, various print agents such as toner may be used. Further, instead of a serial scan type such as the one used in the above embodiments, the printing apparatus may be of what is called a full line type in which an elongate print head extending in the width direction of the printing medium is used.

The print position adjusting pattern has only to allow print position adjustment values to be acquired by using the optical sensor to detect the results of printing. The print position adjusting pattern is not limited to the above embodiments. For example, instead of a pattern in which two print positions during the first and second printing deviate relatively as described above, it is possible to use a pattern in which three or more print positions deviate relatively, a pattern with different print conditions, or a pattern printed under predetermined print conditions.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-313178 filed Sep. 4, 2003, which is hereby incorporated by reference herein.

What is claimed is:

1. A printing apparatus for printing on a printing medium by using a print head capable of applying different print agents to the printing medium, the apparatus comprising:

pattern print control means for printing a predetermined print position adjusting pattern on the printing medium by using the print head and at least one of the different print agents;

an optical sensor for detecting optical characteristics of a part of the printing medium in which the print position adjusting pattern is printed; and adjustment value setting means for setting an adjustment value for print position resulting from the at least one print agent, on the basis of a result of detection by said optical sensor, wherein the predetermined print position adjusting pattern is a pattern to be printed by using only the at least one of the different print agents, which can be relatively accurately detected by said optical sensor, wherein said pattern print control means prints the predetermined print position adjusting pattern by using the at least one print agent, among the different print agents, that can be relatively accurately detected by said optical sensor, wherein said adjustment value setting means sets an adjustment value for print position resulting from a print agent that can be relatively inaccurately detected by said optical sensor on the basis of an adjustment value for print position resulting from the at least one print agent that can be relatively accurately detected by said optical sensor, the latter adjustment value being obtained from optical characteristics detected by said optical sensor of a part of the printing medium in which the predetermined print position adjusting pattern is printed by using the at least one print agent that can be relatively accurately detected by said optical sensor, and wherein the print head ejects inks as the different print agents, and said adjustment value setting means substitutes, for an adjustment value for print position resulting from a first ink that can be relatively inaccurately detected by said optical sensor, an adjustment value for print position resulting from a second ink which is ejected from a position adjacent to a position from which the first ink is ejected and which can be relatively accurately detected by said optical sensor.

2. A printing apparatus according to claim 1, wherein said pattern print control means prints the print position adjusting pattern using the at least one print agent that can be relatively accurately detected by said optical sensor instead of printing the print position adjusting pattern using the print agent that can be relatively inaccurately detected by said optical sensor.

3. A printing apparatus according to claim 1, wherein the print agent that can be relatively inaccurately detected by said optical sensor is a print agent for which there is a relatively small difference in the result of detection of the optical characteristics by said optical sensor between a part of the printing medium to which the print agent is applied and a part of the printing medium to which the print agent is not applied, and the at least one print agent that can be relatively accurately detected by said optical sensor is a print agent for which there is a relatively large difference in the result of detection of the optical characteristics by said optical sensor between a part of the printing medium to which the print agent is applied and a part of the printing medium to which the print agent is not applied.

4. A printing apparatus according to claim 1, wherein said pattern print control means causes the print position adjusting pattern to be printed on the printing medium under different print conditions, and wherein when the result of the detection, by said optical sensor, of the part in which the print position adjusting pattern is printed is within a predetermined range, said adjustment value setting means sets corrective values for the print position in accordance with the print conditions used when the print position adjusting pattern is printed.

5. A printing apparatus according to claim 1, wherein said pattern print control means causes the print position adjusting pattern to be printed using a combination of first and second print operations under different print conditions, and wherein said adjustment value setting means sets adjustment values for relative print positions during the first and second print operations on the basis of the result of the detection, by said optical sensor, of the part in which the print position adjusting pattern is printed.

6. A printing apparatus according to claim 1, wherein the print position adjusting pattern is at least either a pattern used to acquire adjustment values for print positions obtained during forward and backward printing when the print head executes bidirectional printing on the printing medium or a pattern used to acquire adjustment values for print positions of print pixels of different sizes printed on the printing medium.

7. A printing apparatus according to claim 1, wherein the print head has a plurality of nozzle rows in which nozzles applying a predetermined print agent are arranged, and wherein the print position adjusting pattern is used to acquire adjustment values for print positions of printing using odd-number-th nozzle rows of the plurality of nozzle rows and printing using even-number-th nozzle rows of the plurality of nozzle rows.

8. A printing apparatus according to claim 1, wherein said optical sensor includes a light emitting section that applies light to the part in which the print position adjusting pattern is printed and a light receiving section that receives reflected light from the part in which the print position adjusting pattern is printed.

9. A printing apparatus according to claim 1, wherein the second ink has an ejection amount and ejection speed substantially equal to those of the first ink.

10. A printing apparatus according to claim 1, wherein said optical sensor detects intensity of a light reflected when a red light is applied to the part in which the print position adjusting pattern is printed, an ink that is relatively inaccurately detected by said optical sensor includes at least either a magenta or yellow ink, and an ink that is relatively accurately detected by said optical sensor includes at least either a black or cyan ink.

11. A printing apparatus according to claim 1, further comprising:

a carriage on which the print head and said optical sensor can be mounted;

moving means for moving said carriage in a main scanning direction; and conveying means for conveying the printing medium in a sub-scanning direction crossing the main scanning direction.

12. A method of setting print position adjustment values for print positions resulting from different print agents in a printing apparatus that uses a print head capable of applying the different print agents to a printing medium, to execute printing on the printing medium, the method comprising:

a step of printing a predetermined print position adjusting pattern on the printing medium by using the print head and at least one of the different print agents;

a step of detecting, by using an optical sensor, optical characteristics of a part of the printing medium, in which the print position adjusting pattern is printed; and a step of setting an adjustment value for print position resulting from the at least one print agent, on the basis of a result of detection by the optical sensor, wherein the predetermined print position adjusting pattern is a pattern to be printed by using only the at least one of the different print agents, which can be relatively accurately detected by the optical sensor, wherein said pattern printing step prints the predetermined print position adjusting pattern by using the at least one print agent, among the different print agents, that can be relatively accurately detected by the optical sensor, wherein said adjustment value setting step sets an adjustment value for print position resulting from a print agent that can be relatively inaccurately detected by the optical sensor on the basis of an adjustment value for print position resulting from the at least one print agent that can be relatively accurately detected by the optical sensor, the latter adjustment value being obtained from optical characteristics detected by the optical sensor of a part of the printing medium in which the predetermined print position adjusting pattern is printed by using the at least one print agent that can be relatively accurately detected by the optical sensor, and wherein the print head ejects inks as the different print agents, and said adjustment value setting step substitutes, for an adjustment value for print position resulting from a first ink that can be relatively inaccurately detected by the optical sensor, an adjustment value for print position resulting from a second ink which is ejected from a position adjacent to a position from which the first ink is ejected and which can be relatively accurately detected by the optical sensor.

13. A printing method for printing on a printing medium by using a print head capable of applying different print agents to the printing medium, the method comprising:

a step of printing a predetermined print position adjusting pattern on the printing medium by using the print head and at least one of the different print agents;

a step of detecting optical characteristics of a part of the printing medium, by using an optical sensor, in which the print position adjusting pattern is printed; and a step of setting an adjustment value for print position resulting from the at least one print agent, on the basis of a result of detection by the optical sensor, wherein the predetermined print position adjusting pattern is a pattern to be printed by using only the at least one of the different print agents, which can be relatively accurately detected by the optical sensor, wherein said pattern printing step prints the predetermined print position adjusting pattern by using the at least one print agent, among the different print agents, that can be relatively accurately detected by the optical sensor, wherein said adjustment value setting step sets an adjustment value for print position resulting from a print agent that can be relatively inaccurately detected by the optical sensor on the basis of an adjustment value for print position resulting from the at least one print agent that can be relatively accurately detected by the optical sensor, the latter adjustment value being obtained from optical characteristics detected by the optical sensor of a part of the printing medium in which the predetermined print position adjusting pattern is printed by using the at least one print agent that can be relatively accurately detected by the optical sensor, and wherein the print head ejects inks as the different print agents, and said adjustment value setting step substitutes, for an adjustment value for print position resulting from a first ink that can be relatively inaccurately detected by the optical sensor, an adjustment value for print position resulting from a second ink which is ejected from a position adjacent to a position from which the first ink is ejected and which can be relatively accurately detected by the optical sensor.

14. A printing apparatus for printing on a printing medium by using a print head capable of ejecting different print agents to the printing medium, the apparatus comprising:

printing means for printing a predetermined print position adjusting pattern on the printing medium by using the print head and at least one of the different print agents;

detecting means for detecting the predetermined pattern printed on the printing medium;

determining means for determining that an adjustment value for print position resulting from a print agent by which the predetermined pattern is printed is set either on the basis of a result of detection, by said detecting means, of the predetermined pattern printed by using the print agent or on the basis of a result of detection, by said detecting means, of the predetermined pattern printed by using another print agent, the determination being performed on the basis of a difference between a result of detection, by said detecting means, of an area on the printing medium on which the predetermined pattern is not printed and a result of detection, by said detecting means, of the predetermined pattern printed by using the print agent; and setting means for setting an adjustment value for print position of a print agent ejected from the print head, on the basis of a result of detection by said detecting means and a determination by said determining means.

15. A printing apparatus according to clam 14, wherein when the difference between the result of detection of the area on the printing medium on which the predetermined pattern is not printed and the result of detection of the predetermined pattern is smaller than a predetermined value, said determining means determines that said setting means is to set, as an adjustment value for the print position resulting from the print agent, an adjustment value for the print position obtained on the basis of results of detection of the predetermined pattern printed by using a different print agent.

16. A printing apparatus according to clam 14, wherein said detecting means comprises a light emitting section that irradiates the printing medium with light and a light receiving section that receives light reflected by a front surface of the printing medium.

17. A printing apparatus for printing on a printing medium by using a print head capable of applying different print agents to the printing medium, the apparatus comprising:

an optical sensor for detecting optical characteristics of a part of the printing medium in which a predetermined pattern is printed;

pattern print control means for printing the predetermined pattern on the printing medium by using the print head and at least one print agent; and adjustment value setting means for setting an adjustment value for print position resulting from the at least one print agent, on the basis of a result of detection by said optical sensor, wherein the predetermined pattern is a pattern to be printed by using only the at least one print agent, which can be relatively accurately detected by said optical sensor, wherein said pattern print control means prints the predetermined pattern by using the at least one print agent, among the different print agents, that can be relatively accurately detected by said optical sensor, wherein said adjustment value setting means sets an adjustment value for print position resulting from a print agent that can be relatively inaccurately detected by said optical sensor on the basis of the adjustment value for print position resulting from the at least one print agent that can be relatively accurately detected by said optical sensor, and wherein the print head ejects inks as the different print agents, and said adjustment value setting means substitutes, for an adjustment value for print position resulting from a first ink that can be relatively inaccurately detected by said optical sensor, an adjustment value for print position resulting from a second ink which is ejected from a position adjacent to a position from which the first ink is ejected and which can be relatively accurately detected by said optical sensor.

18. A printing method for printing on a printing medium by using a print head capable of applying different print agents to the printing medium, the method comprising:

a detecting step of detecting optical characteristics of a part of the printing medium in which a predetermined pattern is printed, using an optical sensor;

a pattern print controlling step for printing the predetermined pattern on the printing medium by using the print head and at least one print agent; and an adjustment value setting step for setting an adjustment value for print position resulting from the at least one print agent, on the basis of a result of detection by the optical sensor, wherein the predetermined pattern is a pattern to be printed by using only the at least one print agent, which can be relatively accurately detected by the optical sensor, wherein said pattern print controlling step prints the predetermined pattern by using the at least one print agent, among the different print agents, that can be relatively accurately detected by the optical sensor, wherein said adjustment value setting step sets an adjustment value for print position resulting from a print agent that can be relatively inaccurately detected by the optical sensor on the basis of the adjustment value for print position resulting from the at least one print agent that can be relatively accurately detected by the optical sensor, and wherein the print head ejects inks as the different print agents, and said adjustment value setting step substitutes, for an adjustment value for print position resulting from a first ink that can be relatively inaccurately detected by the optical sensor, an adjustment value for print position resulting from a second ink which is ejected from a position adjacent to a position from which the first ink is ejected and which can be relatively accurately detected by the optical sensor.

* * * * *

UNITED STATES PATENT AND TRADEMARK OFFICE

CERTIFICATE OF CORRECTION

PATENT NO. : 7,396,099 B2
APPLICATION NO. : 10/929685
DATED : July 8, 2008
INVENTOR(S) : Minoru Teshigaware et al.

It is certified that error appears in the above-identified patent and that said Letters Patent is hereby corrected as shown below:

| | | |
|---|---|---|
| Col. 3, | line 2, | "sing" should read --using--. |
| | line 48, | "prints." should read --print--. |
| | line 50, | "line" should read --like--. |
| Col. 5, | line 52, | "12" should read --and 12--. |
| | line 57, | "formed)" should read --formed).--. |
| | line 62, | "12" should read --and 12--. |
| Col. 6, | line 27, | "head cartridge 41" should read --head cartridge 41.--. |
| Col. 7, | line 5, | "channels" should read --channels.--. |
| | line 50, | "conveyed" should read --conveyed.--. |
| Col. 8, | line 8, | "in" should read --ink--. |
| | line 16, | "(Y)b" should read --(Y), and--. |
| | line 42, | "(not shown)" should read --(not shown).--. |
| | line 57, | "form example," should read --for example,--. |
| Col. 9, | line 1, | "that" should read --that,--. |
| | line 40, | "Pint" should read --Print--. |
| Col. 11, | line 55, | "Then," should read --Next,--. |
| Col. 16, | line 32, | "s" should read --as--. |
| Col. 17, | line 64, | "ber b," should read --ber B,--. |

Signed and Sealed this

Thirtieth Day of June, 2009

John Doll

JOHN DOLL
*Acting Director of the United States Patent and Trademark Office*